US007151907B2

(12) United States Patent
Yoshinaga

(10) Patent No.: US 7,151,907 B2
(45) Date of Patent: Dec. 19, 2006

(54) FIXING DEVICE, IMAGE FORMING APPARATUS USING THE SAME AND PROCESS CARTRIDGE

(75) Inventor: Hiroshi Yoshinaga, Ichikawa (JP)

(73) Assignee: Ricoh Company Limited, Tokyo (JP)

( * ) Notice: Subject to any disclaimer, the term of this patent is extended or adjusted under 35 U.S.C. 154(b) by 120 days.

(21) Appl. No.: 10/902,129

(22) Filed: Jul. 30, 2004

(65) Prior Publication Data

US 2005/0025539 A1 Feb. 3, 2005

(30) Foreign Application Priority Data

Jul. 30, 2003 (JP) ..... 2003-203761
Dec. 18, 2003 (JP) ..... 2003-421230

(51) Int. Cl.
*G03G 15/20* (2006.01)

(52) U.S. Cl. ..... 399/333; 399/328; 399/329

(58) Field of Classification Search ..... 399/328, 399/329, 331, 333; 347/156
See application file for complete search history.

(56) References Cited

U.S. PATENT DOCUMENTS

| | | | | |
|---|---|---|---|---|
| 5,264,902 | A * | 11/1993 | Suwa et al. | 399/333 |
| 5,765,085 | A * | 6/1998 | Law et al. | 399/329 |
| 6,347,211 | B1 * | 2/2002 | Nanataki et al. | 399/328 |
| 6,438,348 | B1 * | 8/2002 | Kobaru et al. | 399/333 |
| 6,485,878 | B1 * | 11/2002 | Nagase et al. | 399/331 X |
| 2003/0134220 | A1 * | 7/2003 | Emoto et al. | 430/109.4 |

FOREIGN PATENT DOCUMENTS

| | | | |
|---|---|---|---|
| JP | 07-219365 | | 8/1995 |
| JP | 08-202191 | | 8/1996 |
| JP | 09-015903 | | 1/1997 |
| JP | 10-307498 | | 11/1998 |
| JP | 11-133665 | | 5/1999 |
| JP | 11-149180 | | 6/1999 |
| JP | 11-184299 | | 7/1999 |
| JP | 11-282307 | | 10/1999 |
| JP | 2000-66451 | * | 3/2000 |
| JP | 2000-292981 | | 10/2000 |
| JP | 2002-40856 | | 2/2002 |
| JP | 2002-82571 | | 3/2002 |
| JP | 2002-251088 | | 9/2002 |
| JP | 2002-287400 | | 10/2002 |
| JP | 2002-341686 | | 11/2002 |
| JP | 2002-351143 | | 12/2002 |
| JP | 2002-351246 | | 12/2002 |
| JP | 2003-76190 | | 3/2003 |
| JP | 2003-98872 | | 4/2003 |
| JP | 2003-202701 | | 7/2003 |

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A fixing device configured to fix the toner image borne on a side of a transfer material. The fixing device including a heating member configured to heat the toner image while contacting the toner image borne on the transfer material and a pressing member configured to press the transfer material to the heating member. Further, a surface of the pressing member has a property such that the toner particles forming the toner image are not electrostatically repelled from the transfer material toward the heating member.

17 Claims, 5 Drawing Sheets

FIXING DEVICE, IMAGE FORMING APPARATUS USING THE SAME AND PROCESS CARTRIDGE

BACKGROUND OF THE INVENTION

1. Field of the Invention

The present invention relates to a fixing device to fix a toner image onto a transfer material which is developed from a latent image bearing member. The present invention also relates to an image forming apparatus using the fixing device and a process cartridge detachably attached to the image forming apparatus.

2. Discussion of the Background

An electrophotographic developing device is typically used for image forming methods such as electrophotography, electrostatic recording and electrostatic printing. The image forming methods typically include the following processes:

(1) an electrostatic latent image formed on an image bearing member, such as a photoreceptor or a dielectric material, is developed with a developer including a toner to form a toner image on the image bearing member (developing process);

(2) the toner image is transferred on a receiving material, such as a receiving paper, optionally via an intermediate transfer medium (transfer process); and (3) the toner image is fixed on the receiving material upon application of heat and/or pressure, or the like (fixing process).

As one of the structures of such fixing devices, there is a heat roller fixing system. Such fixing systems use a heat roller having a built-in heat source and a pressing roller facing the heat roller. The heat roller and the pressing roller form a fixing nip portion.

In this heat roller fixing system, the roller used is typically made of a material having a relatively large heat capacity. Thus, it takes a long time before the roller is heated to a determined temperature (this time is hereinafter referred to as a rise-up time).

To shorten the rise-up time, published unexamined Japanese patent application (hereinafter referred to as JOP) No. 11-282307 describes a fixing device using a belt which is stretched over rollers and which stores a heating member configured to contact and heat toner images. In addition, a fixing device having a belt stretched over rollers (hereinafter referred to as belt fixing device) has been widely used in terms of energy saving and reduction in size. This is because belts have structural and characteristic advantages over rollers. One of such advantages is that a belt has relatively small volume comparative with that of a roller. Another such advantage is that thin belts can have a low heat capacity. Therefore the rise-up time can be shortened. Yet another advantage of using a belt is flexibility. Thus, when a belt is used as a heating member, it is possible to widen the contact area of the belt and the pressing member and the heat transfer area.

FIG. 1 is a diagram illustrating such a belt fixing system 50. Instead of using a heat roller, a belt 52 stretched over two rollers 53 and 54 is used. A pressing roller 51 faces the roller 54. The roller 53 contains a heat source for heating the belt 52 from the rear surface thereof. In addition, the pressing roller 51 has another heat source for heating the belt 52 from the front surface thereof.

At the time of fixing, the toner is fused by heat and pressure. Then some of the fused toner particles may be transferred-to the heating member (i.e., "hot offset"). In attempts to avoid this hot offset, for example, an offset prevention layer is formed on the heating member by coating a fluorine resin, etc. on the surface of the heating member. Alternatively, a material having a good release property such as silicone oils is applied to the surface of the heating member.

With regard to toner offsets to a heating member, other than the hot offset, there is another offset referred to as "electrostatic offset." One phenomenon caused by such offset is that unfixed toner particles before fusing are attracted to the heating member.

This electrostatic offset happens when the toner particles weakly attached to a transfer material by its viscosity and electrostatic force reach the fixing nip portion formed by the heating member and the pressing member. At this point, some of the toner particles may be transferred onto the heating member and fused by the heating member when heat is applied to the transferred toner particles. Further, when the transferred toner particles contact the transfer material again while the transferred toner particles are still in a fusion state, the toner particles may be transferred thereto, resulting in contamination of the transfer material.

One of the causes of the electrostatic offset is triboelectric charging of fixing members, i.e., heating members and pressing members. That is, due to the difference in the processing precision levels between a heating member and a pressing member, the pressing member and the heating member may move at different speeds and then friction between both members may occur. When a transfer material moves through the fixing nip portion in such a state, triboelectic charging tends to occur since the heating member, the pressing member and the transfer material move at different speeds. Therefore, the heating member attracts the toners carried on the transfer material by electrostatic force caused by the triboelectric charging or by van der Waals force. In addition, the causes of triboelectric charging of the heating member are not only the difference in the processing precision levels. If the heating member thermally expands, its linear speed changes and triboelectric charging occurs.

To prevent the toner particle affection caused by the electrostatic offset ascribable to this triboelectric charging of the fixing members, it is known that a cleaner is provided to clean the surface of the fixing belt after the surface passes through the fixing nip portion. However, a problem occurs to even a fixing device having a cleaner when small sized recording media such as post cards are transferred in a row. That is, the temperature of the surface of the fixing belt which such recording media do not contact rises high relative to that of the surface of the fixing belt which the recording media contact. This relatively high temperature is high enough to fuse the toner particles collected by and located on the cleaner and the fused toner particles are attached to the fixing belt, resulting in contamination of recording media. In addition, it is inevitable that a fixing device having a cleaner is complicated and increased in size. In attempting to avoid this electrostatic offset, JOP No. 2002-40856 describes a fixing device using a heating member without such a cleaner. In the fixing device, the heating member such as heat rollers having a releasing layer on its surface is provided so as to contact a toner image. The releasing layer has a determined surface resistance and volume resistance (i.e., not greater than $1\times10^{8}$ Ω and not greater than $1\times10^{13}$ Ω·cm, respectively). But the surface resistivity determined above is with regard to the fixing roller (i.e., heat roller) which contacts unfixed toners on a recording medium. The surface resistivity of the pressing roller which contacts the other side of the recording medium is not discussed.

JOP No. 2003-76190 describes a fixing device including a pressing roller having a predetermined surface resistivity. The pressing roller has a surface resistance not greater than $1\times10^6$ Ω when 500 V is applied. However, this fixing device aims to prevent electrostatic offset occurring at the time of rear end detachment of a recording medium. In addition, it is preferred electrostatic offset can be prevented without applying a bias to the pressing roller.

On the other hand, to satisfy a recent increasing demand for quality images, developers, especially toners, have been targeted for improvement. Conventional toners prepared by kneading and pulverizing have irregular forms and therefore are disadvantageous with regard to particle diameter distribution, fluidity and transferability. Further, such irregular form toners have prongs to which charges are easily concentrated, resulting in deterioration of charge ability of the toner. Instead of using this type of toner, for example, JOP No. 2002-351143 describes toners prepared by polymerization methods free from pulverization process.

As discussed above, triboelectric charging causing the electrostatic offset is mainly due to the difference in linear speeds among the members used for fixing and the transfer material, however currently it is practically impossible to eliminate the speed difference. Therefore, to address this electrostatic offset problem, it is important to provide a heating member having a structure such that the toner particles are prevented from adhering to the heating member contacting the toner particles, as described in JOP No. 2002-40856 described above.

However, the transfer of toner to a heating member is caused by not only van der Waals forces or the electrostatic force caused by triboelectric charging, but also by a repulsive force generated when the charge polarity of some of the toner particles and a pressing member is the same.

When a pressing member and toner particles on a transfer material have the same charge polarity, the toner particles may be also transferred to a heating member. That is, the toner particles charged with the same polarity as that of the pressing member receive a repulsive force from the pressing member and thereby fly and may attach to the heating member.

The toners carried on the transfer material may have the same polarity as that of the pressing member. This is caused by an AC bias which may be applied at the time of image transfer. In this case, the toner includes reversely charged toner particles. When such reversely charged toner particles face the pressing member, the reversely charged toner particles and the pressing member receive a repulsive force from each other.

As described above, JOP No. 2003-76190 describes a fixing device using a pressing member having a predetermined surface resistivity. This structure has a purpose of preventing uneven surface potential at the heating member when a bias is applied between the heating member and the pressing member. This uneven surface potential at the heating member is caused by detachment discharge generated when the rear end of a transfer material detaches from the fixing member. Therefore, this fixing device using a pressing member having a predetermined surface resistivity can prevent toner attraction to a heating member caused by repulsion between the heating members and the toner particles ascribable to uneven surface potential at the surface of the heating member. Thus, the toner attraction caused by the triboelectric charging mentioned above resulting from the difference in linear speeds of the heating member, the pressing member and the transfer material cannot be prevented by the fixing device using a pressing member having a predetermined surface resistivity.

In attempting to fulfill a need for quality images which has recently been increased, polymerized toners are often used instead of the toners prepared by conventional pulverization process to improve size distribution and fluidity. However, polymerized toners tend to be affected by environmental factors such as humidity. Thus, the repulsion force between the pressing member and the toners may increase depending on charge quantity of the toner which widely changes depending on environmental conditions.

Because of these reasons, a need exists for a fixing device capable of reducing the amount of toner offset to produce quality images by using polymerized toners.

SUMMARY OF THE INVENTION

Accordingly, an object of the present invention is to provide a fixing device and an image forming apparatus having a structure which can reduce occurrence of contamination to a transfer material by surely preventing toners from transferring to the heating member included in the fixing device to produce quality images.

Briefly this object and other objects of the present invention as hereinafter will become more readily apparent can be attained by a fixing device configured to fix a toner image borne on a side of a transfer material including a heating member configured to heat the toner image while contacting the toner image borne on the transfer material. The fixing device further contains a pressing member configured to press the transfer material to the heating member. Furthermore, a surface of the pressing member has a property such that the toner particles forming the toner image are not electrostatically repelled from the transfer material toward the heating member.

It is preferred that, in the fixing device mentioned above, the pressing member has a surface potential such that the toner particles are not electrostatically repelled from the transfer material toward the heating member.

It is still further preferred that, in the fixing device mentioned above, the pressing member has a surface potential not greater than 100 V in absolute value.

It is still further preferred that, in the fixing device mentioned above, a surface potential of the endless belt is not greater than 30 V in absolute value at a portion which is located just before the contact nip formed by the endless belt and the pressing member.

It is still further preferred that, in the fixing device mentioned above, the heating member includes an endless belt, and the pressing member includes a roller which forms a contact nip with the endless belt while interlockingly rotating with the endless belt. In addition, the roller has a surface potential such that the toner particles are not electrostatically repelled toward the endless belt.

It is still further preferred that, in the fixing device mentioned above, the pressing member has a surface resistivity not greater than $1\times10^8$ (Ω/□).

It is still further preferred that, in the fixing device mentioned above, the heating member has a surface resistivity not greater than $1\times10^{12}$ (Ω/□).

As another aspect of the present invention, an image forming apparatus is provided that includes a latent bearing member configured to bear a latent electrostatic image, a developing device configured to develop the latent electrostatic image formed on the image bearing member with a toner, a transfer device configured to transfer the toner image formed on the latent image bearing member to a recording material and the fixing device mentioned above.

It is preferred that, in the image forming apparatus mentioned above, the developing device uses a polymerized toner as an image forming material to form an image on a recording material. The polymerized toner is prepared by a method including the steps of: dissolving or dispersing a modified polyester prepolymer, a compound to perform at least one of an elongation reaction and a cross-linking reaction with the modified polyester prepolymer, and a toner constituent containing a colorant in an organic solvent to obtain a toner composition material liquid; performing at least one of an elongation reaction and a cross-linking reaction of the toner composition material liquid in an aqueous medium to obtain a dispersion liquid; and removing the organic solvent from the dispersion liquid.

It is still further preferred that, in the image forming apparatus mentioned above, the colorant dispersed in the polymerized toner have a number average dispersion particle diameter not greater than 0.5 μm and a number ratio of the colorant having a particle diameter not less than 0.7 μm is not greater than 5% by number.

It is still further preferred that, in the image forming apparatus mentioned above, the colorant contained in the polymerized toner has a number average dispersion particle diameter not greater than 0.3 μm and a number ratio of the colorant having a particle diameter not less than 0.5 μm is not greater than 10% by number.

It is still further preferred that, in the image forming apparatus mentioned above, the polymerized toner has a weight average particle diameter of from 3.0 to 7.0 μm and a particle diameter distribution satisfying the following relationship: $1.00 \leqq Dv/Dn \leqq 1.20$, where Dv and Dn represent a weight average particle diameter and a number average particle diameter, respectively.

It is still further preferred that, in the image forming apparatus mentioned above, the polymerized toner has a circularity of from 0.900 to 0.960.

It is still further preferred that, in the image forming apparatus mentioned above, a portion of the polyester resin contained in the polymerized toner which is soluble to tetrahydrofuran has a main peak in an area ranging from a molecular weight of 2,500 to 10,000 in a molecular weight distribution and a number average molecular weight of from 2,500 to 50,000.

It is still further preferred that, in the image forming apparatus mentioned above, the polyester resin contained in the polymerized toner has a glass transition temperature of from 40 to 65° C. and an acid value of from 1 to 30 mg[KOH]/g.

It is still further preferred that, in the image forming apparatus mentioned above, the compound to perform at least one of an elongation reaction and a cross-linking reaction with the modified polyester prepolymer is an amine and a polyester resin inactive with the amine is dissolved in the toner composition material liquid of the polymerized toner.

It is still further preferred that, in the image forming apparatus mentioned above, a developer comprising the polymerized toner and a carrier is used.

As another aspect of the present invention, a process cartridge is provided which includes at least one of a latent image bearing member, a developing device, a transferring device, and a cleaner. In addition, the process cartridge is detachably attached to the image forming apparatus mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

Figure 1:
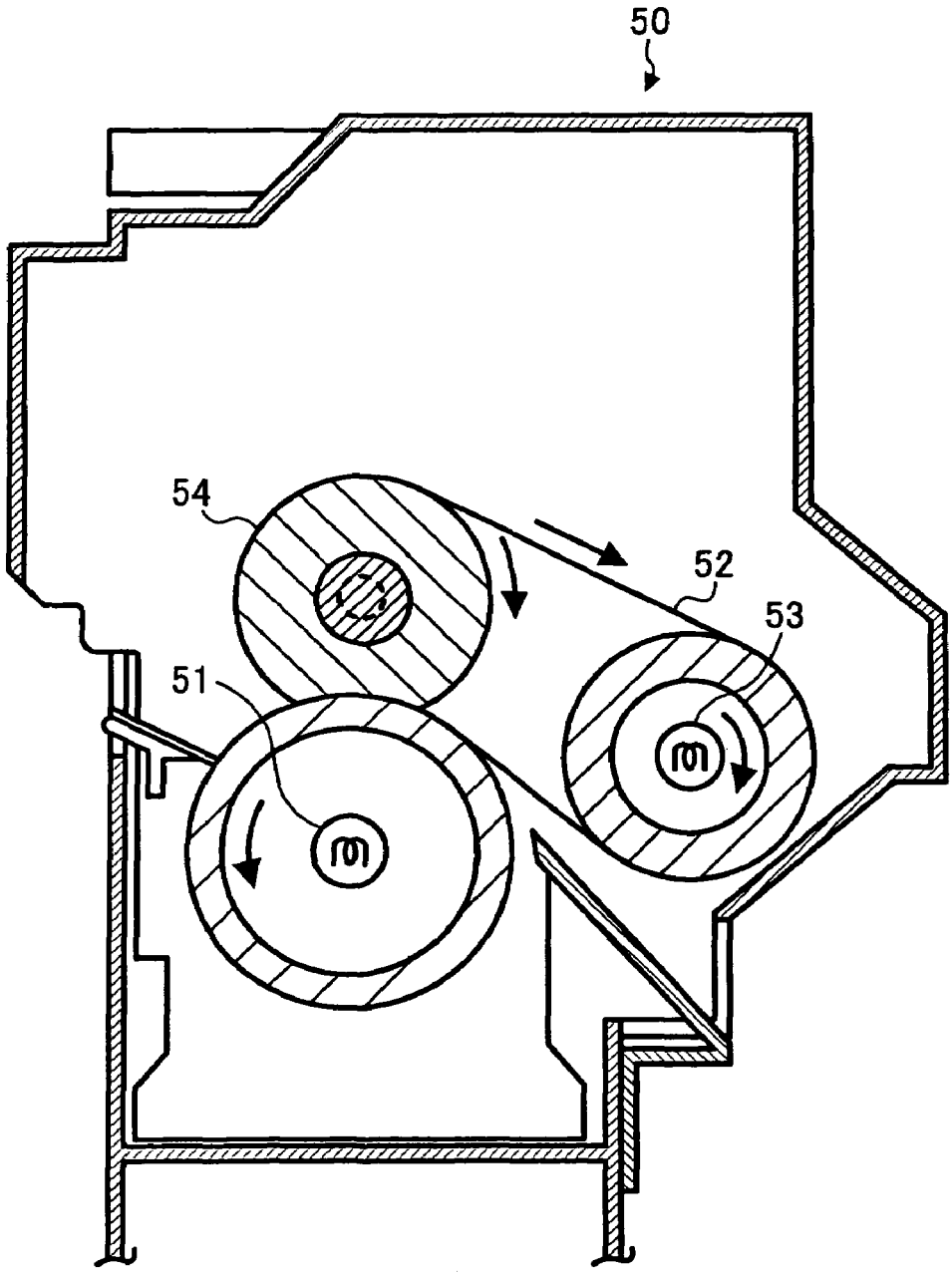
FIG. 1 PRIOR ART
FIG. 1 is a schematic diagram illustrating the fixing device in the prior art.
Figure 2:
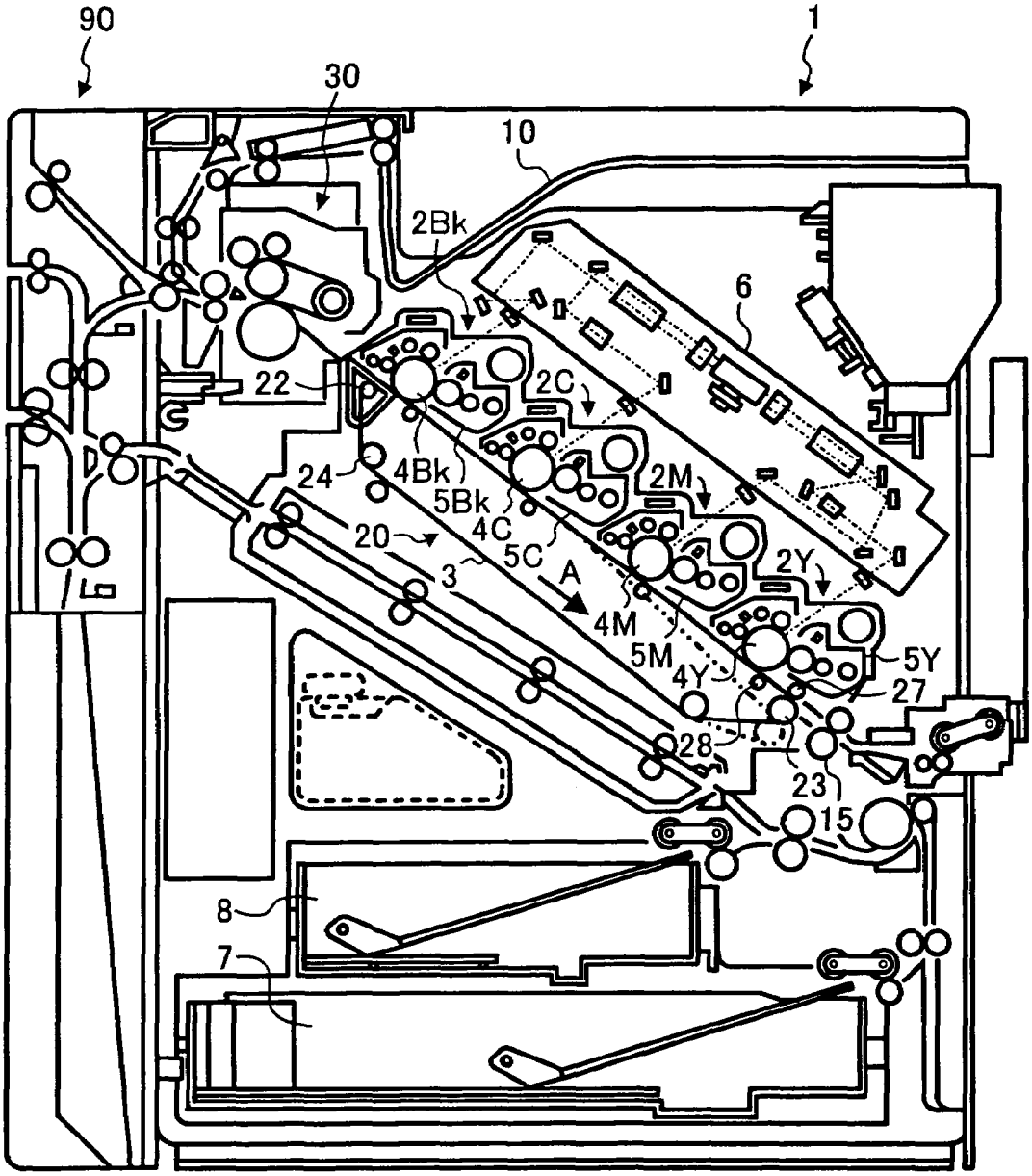
FIG. 2 is an entire structural diagram illustrating the embodiment of the image forming apparatus.

FIG. 2 is an electrophotographic full color printer illustrated as an embodiment of the image forming apparatus of the present invention. In FIG. 2, a plurality of image bearing members, (i.e., photoconductor units of 2Y, 2M, 2C and 2Bk), are detachably provided to an image forming apparatus 1 having a box form. Characters (i.e., Y, M, C and Bk) put in back of the number represents yellow, magenta, cyan and black, indicating that respective members for these respective colors.

A transfer conveying belt device 20 is diagonally disposed at the center of the image forming apparatus 1. The transfer conveying belt 20 includes multiple rollers, which are a driving roller 22, a driven roller 23 and tension rollers 24 and 25, and an endless transfer belt 3 configured to carry recording materials, (i.e., transfer material such as recording paper). The transfer belt 3 is stretched over the multiple rollers and rotatably movable in the direction indicated by the arrow A. Each color photoconductor unit 2Y, 2M, 2C and 2Bk having photoconductor drums 4Y, 4M, 4C and 4Bk, respectively, are provided on the upper outside of the transfer belt 3. On the upper inside of the transfer belt 3 are provided transfer bias members 28 having a transfer means composed by, for example, a transfer brush or a transfer roller. The transfer bias members 28 are disposed facing the photoconductor drums. In FIG. 2, the transfer rollers are placed facing the photoconductor drums with the transfer belt therebetween for the sake of simplicity. The transfer bias members 28 are biased to have a polarity (i.e., positive polarity in the embodiments of the present invention) opposite to that of the correctly charged toner particles (i.e., negative polarity in the embodiments of the present invention). A paper attracting roller 27 is provided on the driven roller 23 with the transfer belt there between. The recording paper is discharged to the transfer belt 3 through the nip formed between the driven roller 23 and the paper attracting roller 27. Since the paper attracting roller 27 is biased at the time, the recording paper transferred to the transfer belt 3 is electrostatically attached to the transfer belt 3. In the embodiment of the present invention, the transfer conveying belt 20 extends in the image forming apparatus 1 in a diagonal way and therefore occupies a small space therein in the horizontal direction.

The photoconductor units 2Y, 2M, 2C and 2Bk contain respective photoconductors having a drum form 4Y, 4M, 4C and 4Bk. Each photoconductor is located above the transfer belt and on the transfer belt 3. The photoconductors 4Y, 4M, 4C and 4Bk can have a belt form.

The photoconductor units 2Y, 2M, 2C and 2Bk are configured to form respective color images of yellow, magenta, cyan and black on the photoconductors 4Y, 4M, 4C and 4Bk. These four units are all the same except for the locations thereof in the image forming apparatus 1. Therefore, the description of the photoconductors is made by representatively using the photoconductor unit 2Y for yellow.

A developing device 5Y is placed facing the photoconductor 4Y and develops a latent electrostatic image on the photoconductor 4Y while supplying a two component developer containing yellow toner and a carrier onto the latent electrostatic image.

A writing system 6 functioning as irradiating means is disposed above each photoconductor unit inclusive of the photoconductor unit 2Y. A duplex unit is disposed below each photoconductor unit inclusive of the photoconductor unit 2Y. Below the duplex unit are provided paper feeder units 7 and 8 capable of accommodating transfer materials in different sizes.

A fixing device 30 is placed near the transfer belt 3 which has passed each photoconductor unit.

Figure 3:
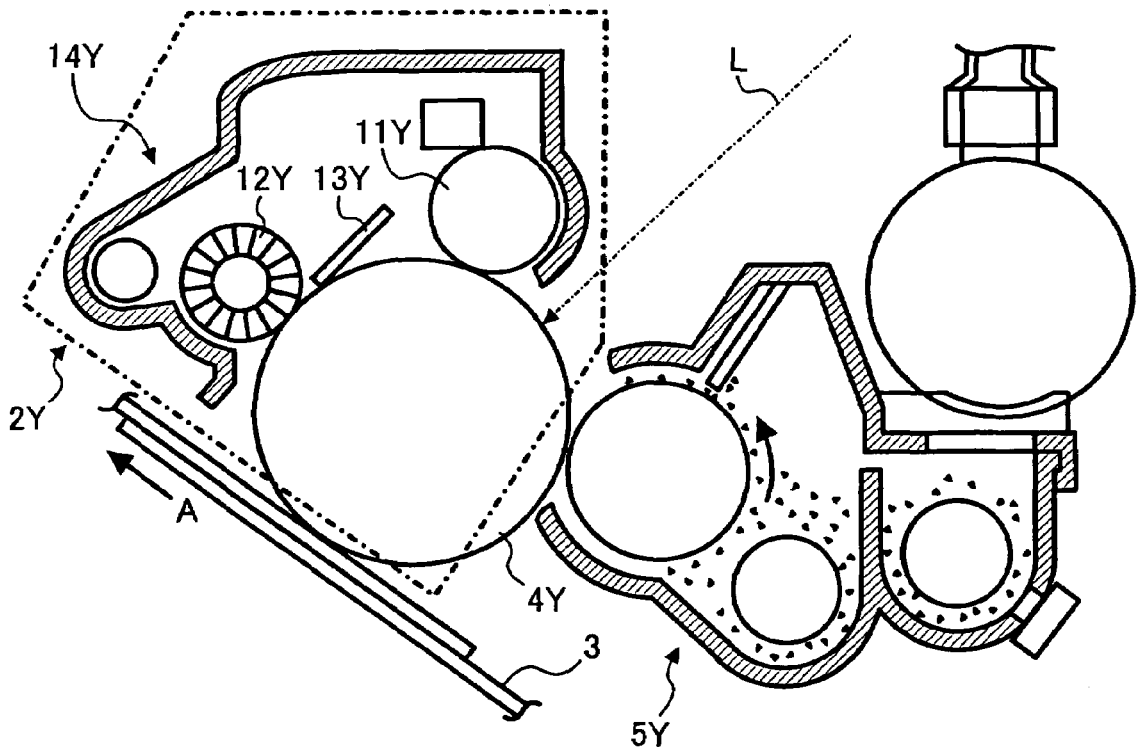
FIG. 3 is a schematic structure illustrating the embodiment of the photoconductor unit for yellow.

Each photoconductor unit constitutes a process cartridge which is detachably attached to the image forming apparatus 1. In the embodiment of the present invention, the process cartridge has a casing which forms a contour thereof indicated by chain double-dashed lines in FIG. 3. In FIG. 3, the photoconductor unit 2Y contains the photoconductor 4Y, a charging roller 11Y functioning as a charging means while in contact with the photoconductor 4Y, and a cleaning device 14Y. The cleaning device 14Y cleans the surface of the photoconductor 4Y with a brush roller 12Y and a cleaning blade 13Y. Thus, this detachable process cartridge makes it possible to separately replace each of the photoconductors 4, etc., resulting in improvement in maintainability.

The behaviors of the image forming apparatus 1 are now described with reference to FIG. 3. In the embodiment of the present invention, when an instruction of the image formation is provided from an operating portion (not shown), a driving force (not shown) drives the photoconductor 4Y clockwise. The charging roller 11Y in the photoconductor unit 2Y is biased by a power source (not shown) and uniformly charges the photoconductor 4Y. After the photoconductor 4Y is charged, the photoconductor 4Y is irradiated by the writing device 6 with a light beam L modulated based on the yellow color image data. Consequently a latent electrostatic image is formed on the surface of the photoconductor 4Y. Then the developing device 5Y develops the latent electrostatic image on the photoconductor 4Y and a yellow toner image is obtained.

With regard to the recording paper, a sheet of recording paper serving as recording medium is detached from the paper feeder cassette which is chosen from the paper feeder unit 7 or 8. Then the recording paper bumps a register roller 15 disposed between the paper feeder cassette and the photoconductor unit 2Y. Then the recording paper is sent to the obverse side of the transfer belt 3 and conveyed to the transfer points facing each photoconductor 4Y, 4M, 4C and 4Bk as synchronized to the transfer timing. At these transfer points, a transfer electric field is formed by the function of a bias applied to the transfer bias member 28 disposed at the reverse side of the transfer belt 3. By this transfer electric field, each color toner image on each photoconductor drum 4Y, 4M, 4C and 4Bk is transferred and overlapped accordingly on the recording member. When a black and white color image is printed, the black toner image is formed only on the photoconductor drum 4Bk of the image forming unit 2Bk for black color. At this point, the transfer belt 3 is detached from the other color photoconductor units as illustrated in the chain double-dash line in FIG. 2. Then the transfer belt 3 conveys the recording paper to the transfer timing of the black toner image to perform the transfer of only the black toner image.

The recording paper on which each color toner image has been transferred is detached at the driving roller 22 from the transfer belt 3 by curvature separation and conveyed to the fixing device 30. When the recording paper passes through the fixing nip of the fixing device 30, heat and pressure are applied to the overlapped toner image to fix it onto the recording paper. Subsequent to the fixing, the recording paper is discharged to an output tray 10 located at the upper face of the image forming apparatus 1 or guided to a duplex device represented by the number 90 in FIG. 2.

Figure 4:
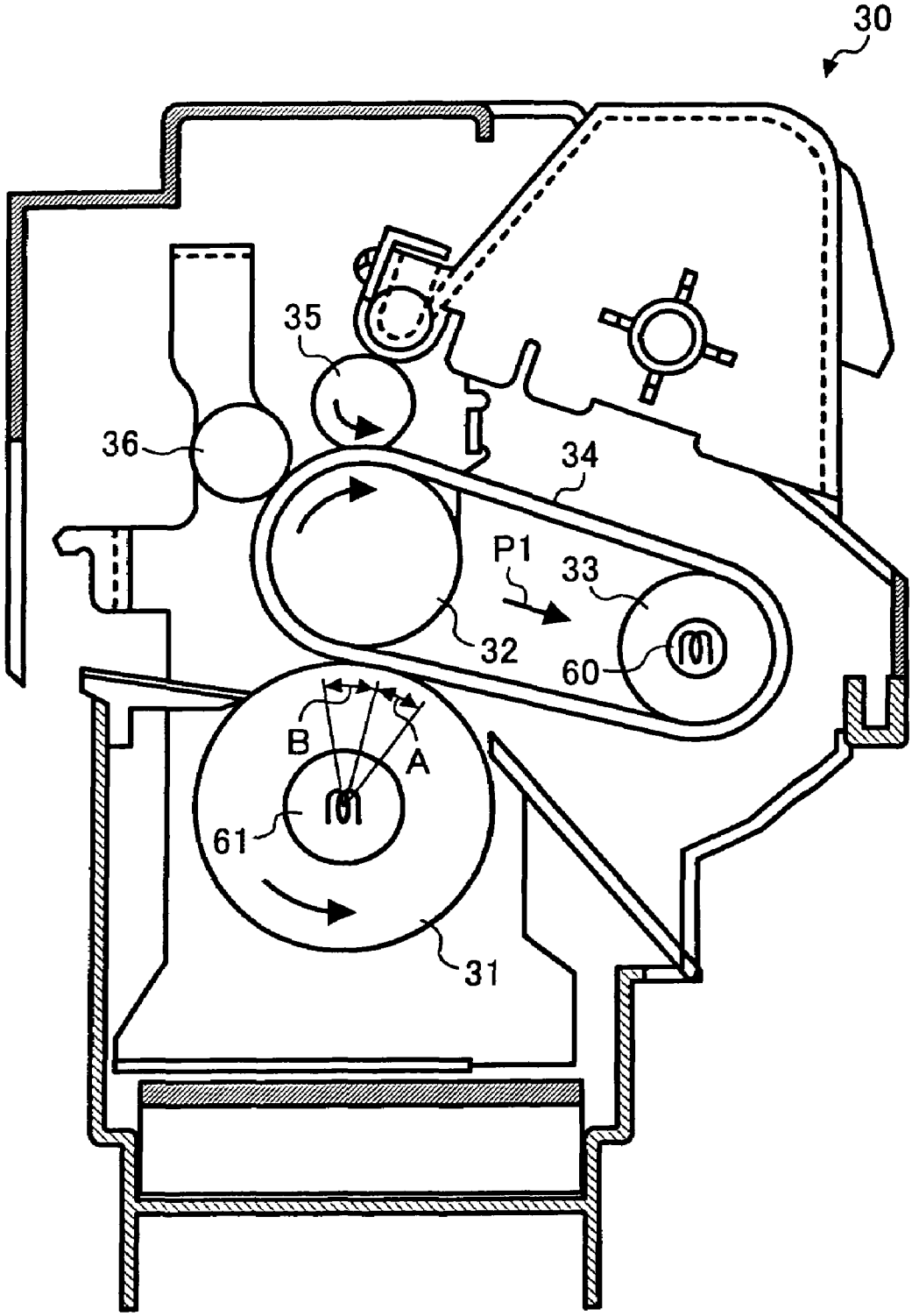
FIG. 4 is a schematic diagram illustrating the embodiment of the pressing roller.

Next the characteristic portion of the embodiment of the present invention (i.e., the fixing device 30) is described. FIG. 4 is a schematic diagram illustrating an embodiment of the fixing device of the present invention. In the embodiment of the present invention, a belt fixing method is adopted and thus an endless fixing belt 34 configured to convey sheets of recording material carrying toners is stretched over a backup roller 32 and a heat roller 33. The fixing belt 34 constitutes a heating member, which faces and heats toners carried on the recording material.

The backup roller 32 and a pressing roller 31 contact and press each other to form a fixing nip with the fixing belt therebetween. The heat roller 33 and the pressing roller 31 contain heaters 60 and 61, respectively. A temperature detection member (not shown) such as thermistor to detect the surface temperature of the heat roller 33 for controlling the temperature of the fixing belt 34, and a guide 12 to guide a recording medium to be fixed to the fixing portion are also provided. Further, an oil application roller 35 as a means to apply oil for offset protection and a cleaning roller 36 for the purpose of clearing the belt of toners attached thereto are provided on the fixing belt 34. The fixing belt 34 in the embodiment of the present invention are stretched over a pair of rollers (i.e., the heat roller 33 and the backup roller 32) but can be stretched over the pair of rollers plus at least one other roller. In addition, when oilless type toners are used, the fixing device 30 can dispense with the application roller 35 mentioned above as a means to apply oil for offset protection.

To provide a predetermined tensile force to the fixing belt 34, the heat roller 33 is pressed in the direction indicated by the arrow P1 to be away from the backup roller 32 by an elastic member (not shown) such as a spring. The pressing roller 31 is configured to be in contact with the backup roller 32 to satisfy the condition that the angle formed by the two straight lines drawn from the axial center of the backup roller 32 to that of the heat roller 33 and to that of the pressing roller 31 makes an acute angle. Thereby a fixing area (fixing portions A and B illustrated in FIG. 4) is formed to fix toners on a medium having a sheet form while the medium is nipped in the fixing area, and a heating area is also formed. The fixing portion A is an area where the pressing roller 31 does not face the backup roller 32 but is in contact with the fixing belt 34 only. In contrast, the fixing portion B is an area where the pressing roller 31 contacts the backup roller 32 with the fixing belt 34 therebetween.

Figure 5:
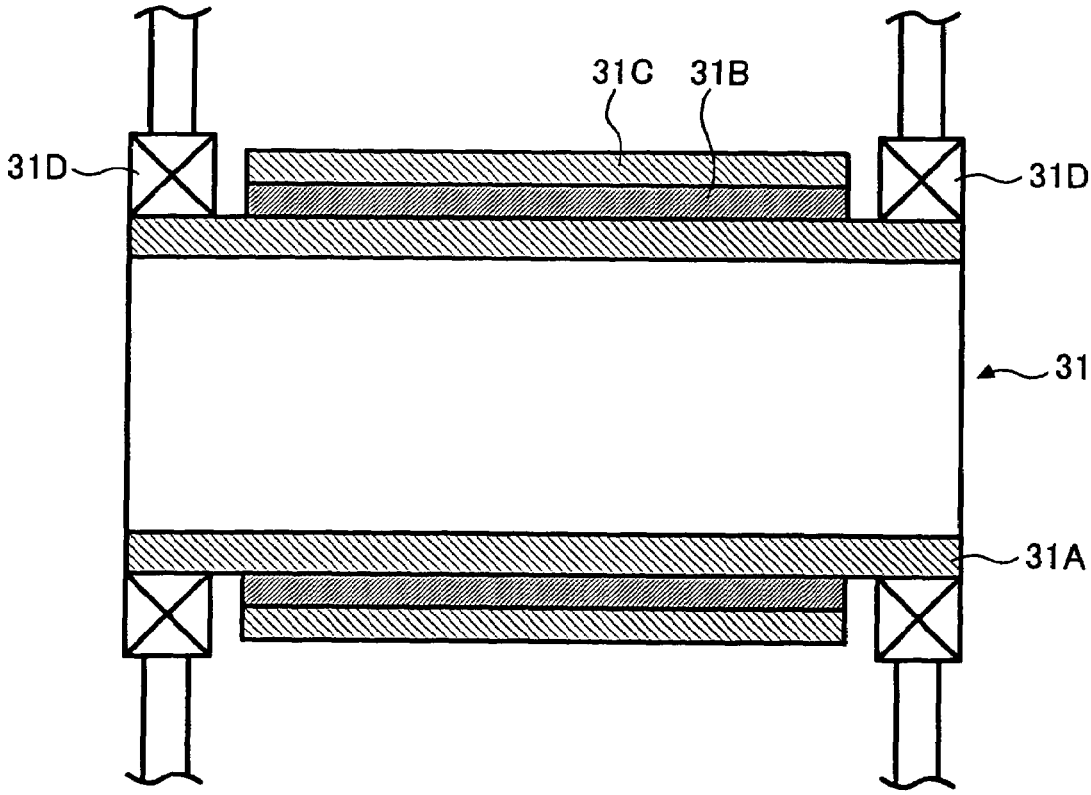
FIG. 5 is a schematic cross section illustrating the embodiment of the fixing roller.

The pressing roller 31, which is a pressing member, can face and contact the fixing belt 34 functioning as a heating member. As illustrated in FIG. 5, the pressing roller 31 has a three-layer structure. The first layer is a metal core 31A made of steel pipe or iron pipe having a thickness of 0.8 mm. On the surface of the metal core 31A, an elastic layer 31B made of silicone rubber having a thickness of 1.0 mm is provided as the second layer. On the surface of the elastic layer 31B, a tube 31C made of a copolymer of tetrafluoroethylene and perfluoroalkylvinyl ether (PFA) having a thickness of 30 μm. The pressing roller 31 is rotated by a rotating means (not shown). The PFA layer and/or the silicone rubber layer have a desired surface resistivity by changing the content of conductive materials such as carbon to be kneaded and mixed therewith.

In the embodiment of the present invention, the surface resistivity and the surface potential of the pressing roller 31 are set to be not greater than $10^8$ Ω/□ and not greater than 100 V.

However, the current manufacturing processes have constraints and the durability and releasability of the pressing roller 31 decline when the content of carbon, etc. is increased. Therefore, the lower limit of the surface resistivity of the pressing roller 31 is preferably not less than $10^3$ Ω/□. In addition, bearings 31D are provided to the edge of the metal core of the pressing roller 31 as illustrated in FIG. 5.

Electric charges generated by triboelectric charging ascribable to the difference between the linear speeds of the pressing roller 31 and the fixing belt 34 are lead from the PFA surface to ground by way of the metal core. Therefore, when the surface resistivity of the pressing roller 31 is low, electric charges generated by triboelectric charging can be removed in a contacting manner and thereby are not retained on the pressing roller 31.

The fixing belt 34 in the embodiment of the present invention has a three-layer structure and a base made of conductive polyimide resin having a thickness of 90 μm. An elastic layer made of silicone rubber having a thickness of 200 μm is provided on the base. Furthermore, a tube surface layer functioning as a surface layer made of PFA or PFA and polytetrafluoroethylene (PTFE) having a thickness of from about 15 to about 30 μm is formed on the elastic layer. The desired surface resistivity can be obtained by changing the content of conductive materials such as carbon to be mixed and kneaded in the silicone rubber layer. The tube layer made of PFA or PFA and PTFE is selected as the surface layer because these are excellent in releasability. The surface resistivity in the embodiment of the present invention is set to be not greater than $10^{12}$ Ω/□. However, the selection of materials is limited because when the surface resistivity is lowered, releasability, durability and others may deteriorate.

The heat roller 33 is made of a metal core made of aluminum and a surface layer made of TEFLON®. The reason why the surface layer is made of TEFLON® is that the TEFLON® surface can prevent twist of the fixing belt 34 and improve anti-abrasion property of the surface of the heat roller 33. In addition, if toners should diffuse to the inside perimeter of the fixing belt 34 and attach to the heat roller 33, the TEFLON® surface can prevent the belt from being damaged. The metal core is preferably made of a material having a small specific heat and a large thermal conductivity. Therefore, metals such as iron, copper and stainless steel can be also used.

The metal core of the heat roller 33 has a bearing on the edge thereof. Thereby the heat roller 33 has a structure such that electric charges on the heat roller 33 are lead to ground by way of the bearing. Thus the inventor of the present invention thinks that the electric charges on the belt generated by triboelectric charging are lead to ground mentioned above via the surface of the heat roller 33.

Therefore, it is logical to think that the heat roller 33 should be made of a metal having a low surface resistivity to improve the flow of the electric charge. However, a heat roller having such a structure is not preferred because if toners should diffuse into the inside peripheral of the fixing belt, a heat roller having such a structure tend to attract the toners and thereby may damage the fixing belt. Consequently, metals such as TEFLON® having a high surface resistivity are unavoidably selected to form the surface of the heat roller.

The backup roller 32 has a metal core surrounded by a porous elastic layer having a high heat resistance. In the embodiment of the present invention, a silicone sponge having a surface hardness of 50S by ASKER C is used. The end of the axis of the backup roller 32 is rotated by a driving means (not shown). Thereby the backup roller 32 rotates, then the heat roller 33 is rotationally driven and the fixing belt 34 is driven. The backup roller 32 is pressed by an elastic substance (not shown) such as spring in the direction to the pressing roller 31. The backup roller 32 is grounded via the axis thereof. However, it is thought to be difficult to lead the electric charges on the fixing belt to ground via the backup roller because the elastic layer has a large volume resistivity.

It is preferred that the pressing roller and the fixing belt have the same linear velocity. But it is hard to achieve the exactly same linear velocity due to thermal expansion, initial forms and the restrictions with regard to the manufacturing precision level. The difference between the linear velocities are preferably from 0.05 to 0.2%.

As recording medium, other than plain paper generally used for photocopying, etc. (hereinafter referred to as "plain paper"), it is possible to use the following: transparent sheets, 90K paper such as cards and post cards; heavy-weight paper weighing greater than 100 g/m$^2$; and special sheets (hereinafter referred to as simply "special sheet") such as envelopes having a large heat capacity relative to plain paper.

The developers are now described. Recently toners prepared by polymerization method (hereinafter referred to as "polymerized toner") have been widely used to respond to the demand for quality images, etc. To overcome the problems stemming from the conventional pulverized toners, polymerized toners are prepared without pulverization processes. Thus kneading and pulverizing processes are not necessary. This greatly contributes to cost reduction because the polymerized toners are prepared with less energy and in shorter time and the yield thereof is improved. Further, it is easy to obtain a sharp size distribution when toners are made by polymerization methods relative to pulverization methods. In addition, wax can be easily contained in polymerized toner particles and the fluidity of the toner particles can be greatly improved. Also the polymerized toners have advantages over the toners prepared by pulverization methods in the light of charging stability, transferability and easiness of obtaining spherical toner particles.

However, polymerized toners still have problems to be solved. When polymerized toners are used as image forming material for a fixing device taking the belt fixing method mentioned above, electrostatic offset occurs more often than when conventional toners are used. In addition, when a cleaner is attached to clear the belt of toner particles attracted thereto, the amount of retrieved toners is large in the case of the polymerized toner relative to that of the pulverized toner. Also, the degree of circularity of polymerized toners is high due to the surface tension acting in the polymerization process. However, the obtained polymerized toner has insufficient toner properties as will be described below. Further, it is not easy to control the form of such toner particles.

In the suspension polymerization methods which are relatively widely used among other polymerization methods, monomers usable for preparing binder resins are limited to styrene monomers, acrylic monomers, etc. These are harmful to human bodies. Consequently, the obtained toners naturally contain these components and therefore cause environmental problems. In addition, the obtained toners contain wax inside the toner particles and therefore the amount of the toners attached to a photoconductor decreases. But therefore the wax does not easily ooze to the toner surface relative to pulverized toners having wax on the surface thereof. Consequently, polymerized toners are not effective about fixing. Therefore, polymerized toners are disadvantageous with regard to power consumption. Then to improve fixability of polymerized toners, the amount of wax can be increased or the wax distribution particle diameter can be enlarged. However, when such toners are used as color toner to obtain color images, transparency thereof deteriorates. Therefore, such toners are not suitable when used to form color images on transparent sheets for presentation.

Other than the suspension polymerization methods, there are other polymerization methods such as emulsion polymerization methods in which the form of toner particles can be easily controlled. Usable monomers in the emulsion polymerization methods are also limited to styrene monomers. As in the case mentioned above, it is difficult to completely remove the unreacted monomers, emulsifiers and dispersants from the toner particles prepared by the emulsion polymerization methods. Therefore, environmental issues are created by using such toners.

Dissolution suspension methods are known as methods of preparing toners. This method has merit in that polyester resins which can be fixed at a low temperature can be used. However, in the process of dissolving or dispersing low temperature fixing resins or colorants in a solvent, high molecular weight components are added. As a result, liquid viscosity of the resultant increases and thereby the productivity of the toner becomes an issue. On the other hand, JOP No. 9-15903 (Japanese Patent No. 3473194) describes a toner made by this dissolution suspension method having a spherical form with rough surface to improve the performance of removing toners. However, such toner particles have an irregular form and therefore lack in charging stability. Further durability and releasability of the toners are bad and therefore the quality thereof is not satisfying.

JOP No. 11-133665 describes a dry toner having a practical circularity of from 0.90 to 1.00 which is composed of elongated resultants of urea-modified polyesters functioning as toner binder to improve fluidity, low temperature fixability and hot offset properties. Further, JOP Nos. 11-149180 and 2000-292981 have described dry toners having a small particle diameter which have excellent powder fluidity, transferability, high temperature preservability, low temperature fixabiilty and hot offset resistance. The toner manufacturing methods disclosed in these patent applications include a process of obtaining high molecular weight toner particles by polyadding polyester prepolymers having an isocyanate group with amines in an aqueous medium.

However, in the case of the polymerized toners obtained by the polymerization method mentioned above, colorants are not well dispersed so that the colorants are unevenly dispersed in the toner particle. Therefore images obtained by using this toner is poor in transparency and color saturation (vividness). Especially when a color image is formed on a transparent sheet using the toner mentioned above, the image obtained is dark.

The polymerized toner used in the embodiments of the present invention is now described in detail. The polymerized toner used in the embodiments of the present invention is obtained by:

(1) at least dispersing polyester prepolymer (A) containing an isocyanate group and colorants and dispersing or dissolving release agents in an organic solvent to obtain a toner component material;
(2) dispersing this toner component material in an aqueous medium in the presence of inorganic particulates and/or particulate polymers;
(3) reacting the prepolymer (A) with polyamines and/or monoamine (B) having an active hydroxyl group to form urea-modified polyester resin C having a urea group; and
(4) removing liquid medium from the resultant dispersion liquid containing the urea-modified polyester resin C.

The urea-modified polyester resin C has a glass transition temperature (Tg) of from 40 to 65° C. and preferably of from 45 to 60° C. In addition, the number average molecular weight Mn of the urea-modified polyester resin C is from 2,500 to 50,000 and preferably from 2,500 to 30,000. The weight average molecular weight Mw of the urea-modified polyester resin C is from 10,000 to 500,000 and preferably from 30,000 to 100,000.

This toner contains the urea-modified polyester resin C as binder resin. The urea-modified polyester resin C has urea linkages and a large molecular weight due to the reaction of the prepolymer (A) and the amine (B). In addition, the colorant is highly dispersed in the binder resin.

As a result of the intensive study on the toner mentioned above, it is found that the obtained toner can have excellent properties with regard to low temperature fixability, charging stability and fluidity by limiting the number average particle diameter of the colorant contained in a toner particle not greater than 0.5 μm when the colorant is dispersed therein and by controlling the ratio of the number of the toner particles having a number average particle diameter not less than 0.7 μm to the total number of the toner particles not greater than 5%. It is also found that quality images, especially color images having excellent transparency and gloss, can be obtained by using this toner.

As a result of the further study, it is found that toners capable of forming further quality images can be obtained by limiting the number average particle diameter of the colorant contained in a toner particle to not greater than 0.3 μm when the colorant is dispersed and by controlling the ratio of the number of the toner particles having a number average particle diameter not less than 0.5 μm to the total number of the toner particles not greater than 10%. Such toners have excellent image resolution and thus are suitable for developing devices taking digital methods. Especially, the color toners according to the embodiments of the present invention are excellent in resolution and transparency and form quality color images having good color reproduction.

The toner mentioned above in which the colorants are uniformly dispersed is not obtained by conventional manufacturing conditions. It is thus necessary to devise manufacturing conditions of the toner.

In the embodiments of the present invention, to obtain the quality toner mentioned above, when forming toner composition material including prepolymer (A), colorants and release agents, it is necessary to adopt a wet pulverization process for the colorant. As wet pulverization device to perform this wet pulverization process, any device which can make an impact on the colorants in a liquid to finely pulverize the colorants is allowed. Specific examples of such devices include various types of known wet pulverizers such as ball mills and beads mills.

In the wet pulverization process, the temperature is from 5 to 20° C. and preferably from 15 to 20° C.

The particle diameter and the size distribution of the colorants included in a toner particle can be controlled within the range mentioned above by adjusting the wet pulverization condition mentioned above. If necessary, the wet pulverization process can be applied to the dispersion liquid obtained after reaction. Further, for the embodiments of the present invention, to obtain the quality toner mentioned above, it is preferred to adopt a method of adding a master batch colorant particles as coloring material in which the colorant is densely dispersed in a resin to the organic solvent followed by stirring and dispersing. The colorant contained in toners obtained by using the master batch particles has a small particle and is uniformly dispersed. Thus color images obtained by using this toner have high transparency.

To prepare such master batch colorant particles in a preferable way, a mixture of a heat melting resin and a colorant is kneaded at the melting point of the resin with a high shearing force. Next the resultant is cooled to be hardened and then pulverized. Specific examples of the resins mentioned above include a heat plastic resin easy to immingle with urea-modified polyester resin C originating from the prepolymer (A). For the embodiments of the present invention, polyester resins are preferably used. The heat plastic resins mentioned above have a softening point of from 100 to 200° C., and preferably from 120 to 160° C., and a number average molecular weight Mn of from 2,500 to 50,000, and preferably from 2,500 to 30,000. The colorant density in the master batch colorant particles mentioned above is from 10 to 60% by weight, and preferably from 25 to 55% by weight.

Next the method of measuring toner properties such as particle diameter of colorants when the colorants are dispersed in the toner is described in detail.

To measure dispersion particle diameter and size distribution of a colorant included in a toner particle, measuring samples where toner particles are embedded in an epoxy resin and segmented to as thin as about 100 nm with Microtome MT6000-XL (available from Meiwa Shoji CO., Ltd.) are prepared. Transmission electron microscope (TEM) photographs are taken for these multiple samples by using an electron microscope (H-9000NAR manufactured by Hitachi, Ltd.) with a magnifying power of from 10,000 to 40,000 while applying an accelerating voltage of 100 kV. Then the obtained image information is converted into image data using an image analyzer (image processing analysis device LUZEX III). Measurement is repeated until sampling of colorant particles having a particle diameter not less than 0.1 μm reaches more than 300 times to obtain the average particle diameter and size (particle diameter) distribution.

The toner of the embodiments of the present invention has a weight average particle diameter (Dv) of from 3 to 7 μm and the ratio (Dv/Dn) of the weight average particle diameter to a number average particle diameter (Dn) satisfies the following relationships: $1.00 \leqq Dv/Dn \leqq 1.20$. By specifying the ratio (Dv/Dn) like this, toners capable of producing quality and high resolution images can be obtained. In addition, to obtain more quality images, it is preferred that the weight average particle diameter (Dv) of a colorant is from 3 to 7 μm, the ratio (Dv/Dn) of the weight average particle diameter (Dv) to the number average particle diameter (Dn) satisfies the following relationships: $1.00 \leqq Dv/Dn \leqq 1.20$, and the number of the toner particles having a particle diameter not greater than 3 μm is from 1 to 10% by number. It is more preferred that the weight average particle diameter (Dv) of a colorant be from 3 to 6 μm and (Dv/Dn) of the weight average particle diameter (Dv) to the number average particle diameter (Dn) satisfy the following relationships: $1.00 \leqq Dv/Dn \leqq 1.15$. Such toners are excellent in high temperature preservability, low temperature fixability and hot offset resistance. Especially when the toners are used for full color photocopiers, the gloss level of the obtained images is excellent. Further, when the toners are used in a double component developer and replenished over a long period of time, the variance of the particle diameters of the toners contained in the developer is small. Furthermore, when the developer is stirred in a developing device for a long period of time, developability is still good and stable.

It is generally said that toners having a small particle have advantages in obtaining high resolution and quality images. However, such toner particles have disadvantages in transferability and cleanability. In addition, when a toner having an average particle diameter below the range specified in the embodiments of the present invention is used as a component in a double component developer, the toner tends to fuse and attach to the surface of the carrier on stirring in a developing device over a long period of time, resulting in deterioration of charging ability of the carrier. In contrast, when such a toner is used as a single component developer, the toner tends to form films on a developing roller and fuse and attach to members such as a blade configured to thin toner layers. These phenomena are greatly relevant to the content ratio of fine powder particles in the toner. Especially when the content of fine particles having a particle diameter not greater than 3 μm is greater than 10%, the toner does not easily attach to the carrier and it is difficult to obtain charging stability at a high level.

To the contrary, when a toner has a particle diameter above the range specified in the embodiments of the present invention, it is difficult to have high resolution and quality images. Further, when the toner included in a developer is replenished, the particle diameter of the toner tends to vary greatly. Furthermore, it is found that this also applies to the case of when the ratio (Dv/Dn) of the weight average particle diameter (Dv) to the number average particle diameter (Dn) is greater than 1.20.

The average particle diameter and size distribution of a toner is measured using Coulter counter method. Specific examples of measuring devices for size distribution of toner particles include COULTER COUNTER® MODEL TA-II and COULTER MULTISIZER® MODEL II (both manufactured by Beckman Coulter, Inc.). In the embodiments of the present invention, COULTER COUNTER® MODEL TA-II is used to output the number distribution and volume distribution using an interface (manufactured by JUSE Press, Ltd.) connected with PC9801 personal computer (manufactured by NEC Corporation).

The measuring methods of number distribution and volume distribution of the toner are described next.

First, 0.1 to 5 ml of a surfactant (preferably a salt of alkylbenzene sulfonate) functioning as dispersant is added to 100 ml to 150 ml of an electrolytic aqueous solution. The electrolytic aqueous solution is about 1% NaCl aqueous solution formed by using primary sodium chloride. For example, ISOTON-II (manufactured by Beckman Coulter, Inc.) is usable. Then 2 to 20 mg of a measuring sample is added. The electrolytic solution in which the measuring sample is suspended is subject to dispersion treatment for about 1 to 3 minutes using a supersonic disperser. The volume distribution and the number distribution of the toner particles are measured with the measuring device mentioned above with an aperture of 100 μm and then calculated.

The targets are toner particles having a particle diameter of from 2.00 to less than 40.30 μm. The channels used are 13 channels of from 2.00 to less than 2.52 μm, from 2.52 to less than 3.17 μm, from 3.17 to less than 4.00 μm, form 4.00 to less than 5.04 μm, from 5.04 to less than 6.35 μm, from 6.35 to less than 8.00 μm, from 8.00 to less than 10.08 μm, from 10.08 to less than 12.70 μm, from 12.70 to less than 16.00 μm, from 16.00 to less than 20.20 μm, from 20.20 to less than 25.40 μm, from 25.40 to less than 32.00 μm, and from 32.00 to less than 40.30 μm. The weight average particle diameter (Dv) based on volume is calculated from the volume distribution of the toner of the embodiment of the present invention and the number average particle diameter (Dn) obtained from the number distribution thereof. Then the ratio of Dv/Dn is calculated.

With regard to hot offset resistance of a toner, various kinds of approaches such as controlling molecular weight distribution of a binder resin have been made. To obtain a good combination of low temperature fixability and hot offset resistance, a method of using binder resins having a wide molecular weight distribution or a method of using a mixture resin having at least two peaks in molecular weight distribution is used. The mixture resin has at least one peak in a high molecular weight component range of several hundreds of thousands to several millions and another peak in a low molecular weight component range of several thousands to several tens of thousands is used. The high molecular weight component having a cross linking structure or in a gel state is more effective to hot offset. However, since gloss and transparency are essential to a full color toner, too much content of the high molecular weight is not preferred. Since the toner of the embodiments of the present invention contains a high molecular weight urea-modified polyester resin having a urea linkage, the toner can achieve good hot offset resistance while satisfying transparency and gloss.

The molecular weight distribution of the binder resin included in a toner is measured by Gel Permeation Chromatography (GPC) as follows:

(1) Throw in 50 to 200 μl of tetrahydrofuran (THF) sample solution including a resin having a weight % of 0.05 to 0.06 to a column stabilized in a heat chamber at 40° C. while flowing THF 1 ml per minute as column solvent at this temperature for measurement; and to obtain the molecular weight of the sample, determine and calculate the molecular weight distribution thereof using the relationship between the logarithm values and count numbers of the working curves formed from several kinds of mono disperse polystyrene standard samples. As such polystyrene standard samples for making working curves, the samples manufactured by Pressure Chemical Co. or Toyo Soda Manufacturing Co. having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ are used. At least about 10 polystyrene standard samples should be used. As detecting device, refractive index (RI) detectors are used.

The main peak molecular weight in the molecular weight distribution of the binder resin components included in a toner is from 2,500 to 10,000, preferably from 2,500 to 8,000 and more preferably from 2,500 to 6,000. When the content of components having a molecular weight less than 1,000 increases, high temperature preservability of the toner tends to deteriorate. To the contrary, when the content of the components having a molecular weight greater than 30,000 increases, simply the low temperature fixability tends to deteriorate but it is possible to restrain the deterioration as much as possible by balance control. The content of the components having a molecular weight greater than 30,000 varies from 1 to 10% depending on toner materials and is more preferably from 3 to 6%. When the content is too few, hot offset resistance is not sufficient. When the content is too much, the gloss and transparency tend to deteriorate. The number average molecular weight Mn of the binder resin included in a toner is from 2,500 to 50,000 and the ratio (Mw/Mn) of the weight average molecular weight of the binder resin to the volume average molecular weight thereof is not greater than 10. When the ratio is too large, the sharp melting property tends to deteriorate, resulting in loss of gloss.

The circularity of the toner of the embodiments of the present invention is measured by flow type particle image analyzer, i.e., FPIA-2000 (manufactured by Sysmex Corporation). The toner of the embodiments of the present invention has an average circularity of from 0.900 to 0.960 and it is important to have a specific form and form distribution. When the average circularity of a toner is too small, the toner particles tend to have an irregular form. Thus transferability of such toner particles is not satisfying. In addition, quality images free from dust are not obtained with such toner particles. Toner particles having an irregular form contact members having a plain face such as a photoconductor with many points and tend to collect charges at these points. Therefore, van der Waals forces and mirror image forces of toner particles having an irregular form are strong relative to those of toner particles having a relatively spherical form. Therefore, in the case of a toner containing particles having an irregular form and particles having a spherical form, the toner particles having a spherical form tend to be selectively transferred in the electrostatic transfer process, resulting in image omission in characteristic portions and line portions.

In addition, it is necessary to remove the remaining toner particles before the next developing process starts. Therefore, toner particles having an irregular form have disadvantages in that a cleaner is required and the toner yield rate (i.e., the ratio of the toner used for image formation) is low. When pulverized toners are measured by this device, the circularity thereof is normally from 0.910 to 0.920.

As a measuring method for toner forms (i.e., circularity), it is suitable to select the following method using an optical detection area: pass a suspension containing toner particles through the image pickup detection area on a plain plate; and optically detect and analyze toner particle images with a charge coupled device (CCD) camera. What is obtained by this method is the projected area of a toner particle and thus the value of the circularity thereof is obtained by dividing the circumferential length of a circle having the same area as the projected area by the circumferential length of the toner particle. This is the value calculated as the average circularity by the flow type particle image analyzer, i.e., FPIA-2000. The specific measuring method is as follows: add a surfactant as dispersant, preferably 0.1 to 0.5 ml of a salt of alkyl benzene sulfonate, to 100 to 150 ml of water free of impurity solid in a container; further add about 0.1 to about 0.5 g of a measuring sample to the aqueous medium to form a suspension; the suspension where the sample is dispersed is subject to dispersion treatment with a supersonic dispersion device for about 1 to 3 minutes; and measure the toner form and toner form distribution with the device mentioned above while setting the density of the dispersion liquid 3,000 to 10,000 particles per μl.

In the manufacturing method of the toner of the embodiments of the present invention, a process of reacting a polyester prepolymer (A) having an isocyanate group which is dispersed in an aqueous medium containing inorganic particulates and/or particulate polymers with an amine (B) to obtain a high molecular weight compound is included. The polyester prepolymer (A) having an isocyanate group can be obtained by reacting a polyester of a polycondensation of a polyol (PO) and a polycarboxylic acid (PC) containing an active hydroxyl group with a polyisocyanate (PIC) Specific examples of such active hydroxyl groups contained in the polyester include hydroxyl groups (alcoholic hydroxyl group and phenol hydroxyl group), amino groups and mercapto groups, and preferably alcoholic hydroxyl groups.

Suitable preferred polyols (PO) include diols (DIO) and polyols (TO) having three or more hydroxyl groups. It is preferable to use diols (DIO) alone or mixtures in which a small amount of a polyol (TO) is added to a diol (DIO).

Specific examples of the diols (DIO) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferred. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIO) and polycarboxylic acids (TC) having three or more carboxyl groups. It is preferred to use dicarboxylic acids (DIO) alone or mixtures in which a small amount of a polycarboxylic acid (TC) is added to a dicarboxylic acid (DIO).

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

Suitable mixing ratio (i.e., an equivalence ratio [OH]/[COOH]) of a polyol (PO) to a polycarboxylic acid (PC) ranges from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

To obtain a polyester prepolymer having an isocyanate group, suitable mixing ratio (i.e., [NCO]/[OH]) of a polyisocyanate (PIC) to a polyester resin (PE) having a hydroxyl group) is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, resulting in deterioration of the hot offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1.0, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Polyamines and/or monoamines having an active hydroxyl group are used as the amine (B). This active hydroxyl group includes hydroxyl group and mercapto group. Specific preferred examples of the amine (B) include diamines (B1), polyamines (B2) having three or more amino groups, amino alcohols (B3), amino mercaptans (B4), amino acids (B5) and blocked amines (B6) in which the amines (B1–B5) mentioned above are blocked. Specific preferred examples of the diamines (B1) include aromatic diamines (e.g., phenylene diamine, diethyltoluene diamine and 4,4'- diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine.

Specific preferred examples of the amino alcohols (B3) include ethanol amine and hydroxyethyl aniline. Specific examples of the amino mercaptan (B4) include aminoethyl mercaptan and aminopropyl mercaptan. Specific preferred examples of the amino acids (B5) include amino propionic acid and amino caproic acid. Specific examples of the blocked amines (B6) of B1 to B5 include ketimine compounds which are prepared by reacting one of the amines (B)1–B5 mentioned above with a ketone such as acetone, methyl ethyl ketone andmethyl isobutyl ketone; oxazoline compounds, etc. Among these amines (B), B1 and a mixture of B1 and a small quantity of B2 are preferable.

Further, when reacting a prepoymer (A) with an amine (B), the molecular weight of the modified polyesters can be controlled using a molecular-weight control agent, if desired.

Specific preferred examples of the molecular-weight control agent include monoamines (e.g., diethyle amine, dibutyl amine (B)utyl amine and lauryl amine), and blocked amines (i.e., ketimine compounds) prepared by blocking the monoamines mentioned above. The added amount of a molecular-weight control agent is dependent on a desired molecular weight of a generated urea-modified polyester.

The mixing ratio of the amines (B) to the prepolymer (A), i.e., the equivalent ratio ([NCO]/[NHx]) of the isocyanate group [NCO] contained in the prepolymer (A) to the amino group [NHx] (x represents a number between 1 and 2) contained in the amines (B), is normally from 1/2 to 2/1, preferably from 1.5/1 to 1/1.5 and more preferably from 1.2/1 to 1/1.2. When the mixing ratio is too large or too small, the molecular weight of the resultant urea-modified polyester (i) decreases, resulting in deterioration of the hot offset resistance of the resultant toner.

In the embodiments of the present invention, at the time of reacting a prepolymer (A) having an isocyanate group with amines (B) in an aqueous medium, it is allowed to have a polyester resin (D) in the aqueous medium which is inactive with the amines (B). This polyester resin (D) has a Tg of from 35 to 65° C. and preferably from 45 to 60° C., and a number average molecular weight Mn of from 2,000 to 10,000 and preferably from 2500 to 8,000. Urea modified polyesters (UMPE) can be used as this polyester resin (D) and this polyester is allowed to have both urea linkage and urethane linkage. The molar ratio of the content containing urea linkage to the content containing urethane linkage is normally from 100/0 to 10/90, preferably from 80/20 to 20/80, and more preferably from 60/40 to 30/70. When the molar ratio of content containing the urea linkage is too small, the hot offset resistance of the toner deteriorates. Urea modified polyesters (UMPE) are manufactured by known methods such as one shot method. The weight average molecular weight of the urea modified polyesters (UMPE) is normally not less than 10,000, preferably from 20,000 to 500,000 and more preferably from 30,000 to 100,000. When the weight average molecular weight of the urea modified polyesters (UMPE) is too small, the hot offset resistance of the toner deteriorates.

In the embodiments of the present invention, the modified polyester resin (i) mentioned above can be used alone, and further an unmodified polyester resin (PE) can be used together with the modified polyester resin (i) as a binder resin component of the toner if necessary. With a combinational use of a modified polyester (UMPE) and an unmodified polyester (PE), the low temperature fixability of the toner can be improved and in addition the toner can produce color images having high gloss. Therefore, the combinational use is preferable to the single use of (UMPE).

Suitable unmodified polyesters (PE) include polycondensation products of a polyol (PO) with a polycarboxylic acid (PC). Specific examples of the polyols (PO) and the polycarboxylic acids (PC) are the same as mentioned above for use in the modified polyester (UMPE). Also suitable molecular weight of (PE) is the same as that of (UMPE) mentioned above.

Furthermore, polyester resins modified by a linkage (such as urethane linkage) other than a urea linkage can be used as unmodified polyester (PE).

It is preferred in the light of low temperature fixability and hot offset resistance that the urea modified polyester (UMPE) and the unmodified polyester at least partially mix with each other. Namely, it is preferred that the urea modified polyester (UMPE) and the unmodified polyester (PE) have a similar structure. When an unmodified polyester (PE) is contained, the mixing ratio (UMPE/PE) of the urea modified polyester (UMPE) to the unmodified polyester (PE) is from 5/95 to 80/20, preferably from 5/95 to 30/70, more preferably from 5/95 to 25/75, and even more preferably from 7/93 to 20/80. When the amount of urea modified polyester (UMPE) is too small, the hot offset resistance of the resultant toner tends to deteriorate and, in addition, it is hard to impart a good combination of high temperature preservability and low temperature fixability to the resultant toner.

It is preferred that the unmodified polyester (PE) have at least 5 hydroxyl groups. The acid value (i.e., mg [KOH]) of the unmodified polyester (PE) is normally from 1 to 30, and preferably from 5 to 20. By adding an unmodified polyester (PE) having an acid value, the resultant toner tends to have a negative charge. Further, at the time of fixing an image onto a paper, the toner and the paper have good attraction, resulting in an improvement of low temperature fixability. However, when the acid value is too large, the charging stability of the toner tends to deteriorate, especially to environmental changes. When an unmodified polyester (PE) having a too large or too small acid value is used in the polyaddition reaction of a prepolymer (A) and an amine (B), the form of the toner particles obtained may vary and thereby it is difficult to have a control in emulsification.

The toner binder for use in the embodiment of the present invention has a glass transition temperature (Tg ) of from 45 to 65° C. and preferably from 45 to 60° C. When the glass transition temperature (Tg) is too low, the heat resistance deteriorates and when the glass transition temperature (Tg) is too high, the low temperature fixability becomes insufficient.

The toner for use in the embodiments of the present invention includes a colorant.

Suitable colorants included in the toner for use in the embodiments of the present invention include known dyes and colorants. Specific examples of the colorants include carbon black, Nigrosine dyes, black ironoxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Colorant Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Colorant Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Colorant Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

It is preferred that the colorants be dispersed in a resin and used as master batch colorant particles as discussed above.

Binder resins are kneaded with colorants in preparing a master batch. Specific examples of such binder resins include modified and unmodified polyester resins mentioned above, polystyrene, terpene resins, aliphatic or alicyclic hydrocarbon resins and aromatic petroleum resins. These resins can be used alone or in combination.

Such master batches are obtained by mixing and kneading a resin and a colorant for the master batch with a high shearing force. At this point, organic solvents can be used to increase the mutual interaction between the colorant and the resin. Also a method referred to as a flushing method is preferably used because a wet cake of a colorant can be used as it is. In this method, an aqueous paste containing water including a colorant is mixed and kneaded with a resin and an organic solvent to move the colorant to the resin. Then the water and the organic solvent are removed. For mixing and kneading, high shearing dispersion devices such as three-roll mill are preferably used.

The toner can include release agent (i.e., wax) together with a toner binder and a colorant. Known waxes for use in conventional toners can be used.

Suitable release agents include polyolefin waxes (e.g., polyethylene waxes and polypropylene waxes); hydrocarbons having a long chain (e.g., paraffin waxes and SASOL waxes); and waxes having a carbonyl group. Among these materials, waxes having a carbonyl group are preferably used for the toner of the present invention.

Specific preferred examples of the waxes including a carbonyl group include polyalkanoic acid esters such as carnauba waxes, montan waxes, trimethylolpropane tribehenate, pentaerythritol tetrabehenate, pentaerythritol diacetate dibehenate, glycerin tribehenate, and 1,18-octadecanediol distearate; polyalkanol esters such as tristearyl trimellitate, and distearyl maleate; polyalkanoic acid amides such as ethylenediamine dibehenylamide; polyalkylamides such as trimellitic acid tristearylamide; dialkyl ketone such as distearyl ketones; etc. Among these materials, polyalkanoic acid esters are more preferred. The waxes normally have a melting point of from 40 to 160° C., preferably from 50 to 120° C. and more preferably from 60 to 90° C. Waxes having too low of a melting point adversely affect high temperature preservability and waxes having too high of a melting point tend to cause cold offset when the toner is fixed at a low temperature. In addition, the wax preferably has a melting viscosity of from 5 to 1000 cps, and more preferably from 10 to 100 cps, at a temperature 20° C. higher than the melting point thereof. Waxes having too high of a melting viscosity are poor at improving hot offset resistance and low temperature fixability.

The content of the wax contained in a toner is normally from 0 to 40% by weight and preferably from 3 to 30% by weight.

The toner for use in the embodiment of the present invention optionally includes a charge controlling agent. Known charge controlling agents can be used for the toner. Specific preferred examples of the charge controlling agents include nigrosine dyes, triphenyl methane dyes, metal compounds dyes including chrome, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

More specific preferred examples of the charge controlling agents include BONTRON 03 (nigrosine dyes), BONTRON P-51 (quaternary ammonium salt), BONTRON E-82 (metal complex of oxynaphthoic acid), BONTRON S-34 (azo dyes containing a metal), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo colorants, and polymers having a functional group such as a sulfonate group, a carboxyl group, a quaternary ammonium group, etc.

The content of charge controlling agents included in the toner for use in the embodiment of the present invention is determined depending on the kind of the toner binder resin used, whether other additives are used, and the toner manufacturing method used (including the dispersing method) and therefore there is no specific limitation thereto. However, it is preferred that the charge controlling agent be used in an amount of from 0.1 to 10 parts by weight per 100 parts by weight of the binder resin and more preferably of from 0.2 to 5 parts by weight. When the amount is greater than 10 parts by weight, the toner is so excessively charged that electrostatic attraction force between the toner and a developing roller increases, resulting in deterioration of fluidity of the developer and deterioration of image density. These charge controlling agents and release agents can be fused and kneaded with a master batch and a resin and can be also added when dissolved and dispersed in an organic solvent.

In order to improve fluidity, developability and chargeability of the toner coloring particles (mother toner particles), inorganic particulates can be preferably added thereto. Such inorganic particulates preferably have a primary particle diameter of from 5 nm to 2 μm and more preferably of from 5 nm to 500 nm. In addition, it is preferred that a specific surface area thereof be from 20 to 500 $m^2/g$ when measured by a BET method. The content of the inorganic particulates in the toner is preferably from 0.01 to 5.0% by weight, and more preferably from 0.01 to 2.0% by weight, based on the total weight of the toner.

Specific preferred examples of such inorganic particulates include silica, alumina, titanium oxide, barium titanate, magnesium titanate, calcium titanate, strontium titanate, zincoxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Other than the above, particulate polymers, (which can be prepared by a method such as soap free emulsion polymerization, suspension polymerization or dispersion polymerization), such as copolymers of polystyrene, methacrylic acid esters and acrylic acid esters, particulate polycondensation compounds (e.g., silicone resins, benzoguanamine resins and nylons), and polymers of thermosetting resins can also be used.

When such external additives (fluidizers) are surface treated to improve hydrophobicity, good fluidity and chargeability can be maintained even in a high humidity environment. Suitable surfactants for use in the hydrophobizing treatment include silane coupling agents, silylation agents, silane coupling agents having a fluorinated alkyl group, organic titanate coupling agents, aluminum coupling agents, silicone oils, modified silicone oils, etc.

The toner can optionally include a cleanability improving agent to easily remove toner particles which remain on an image carrier such as a photoconductor and a first transfer medium after a toner image is transferred.

Specific preferred examples of such cleanability improving agents include fatty acid metal salts such as zinc stearate, calcium stearate and magnesium stearate; and particulate polymers such as polymethyl methacrylate and polystyrene, which can be manufactured by a method such as soap-free emulsion polymerization methods. Such particulate polymers preferably have a relatively sharp particle diameter distribution and a volume average particle diameter of from 0.01 to 1 μm.

Next the method of manufacturing a toner is described in detail. First, in the oily dispersion liquid (i.e., toner component material liquid) preparation process, an oily dispersion liquid is prepared in an organic solvent. The oily dispersion liquid includes dissolved polyester prepolymer (A) including an isocyanate group, a dispersed colorant and a dissolved or dispersed release agent. To finely pulverize and uniformly disperse the colorant in the oily dispersion body, in the wet pulverization process, this oily dispersion body is subject to pulverization treatment by a wet pulverization device. The pulverization treatment time is from about 30 to 120 minutes.

Next, in the dispersion (emulsification) process, the oily dispersion liquid obtained as mentioned above is dispersed (emulsified) in an aqueous medium in the presence of inorganic particulates and/or particulate polymers to form an oily dispersion (emulsion) liquid in the aqueous medium. Further, the polyester prepolymer (A) including an isocyanate group included in the dispersion liquid is reacted with an amine (B) to form a urea-modified polyester resin (C) in the reaction process. The used organic solvent mentioned above dissolves polyester resins and is insoluble or hardly or slightly soluble to water. The organic solvent has a boiling point of from 60 to 150° C., and preferably from 70 to 120° C. Specific examples of such organic solvents include acetic ether and methyl ethyl ketones. It is preferred to use the master batch colorant particles mentioned above as a colorant. Thereby, uniform dispersion of the colorant can be efficiently performed. It is also preferred to dissolve a polyester resin (D) inactive to amines as supplementary component in the organic solvent. In addition, this polyester resin (D) can be dispersed in the aqueous medium.

When the oily dispersion liquid is dispersed in the aqueous medium, there is no specific limit to dispersion devices used. Known dispersion devices taking a method such as a low speed shearing method, a high speed shearing method, a friction method, a high pressure jet method and a supersonic method can be used. High speed shearing dispersion devices are preferred to obtain particles having a diameter of from 2 to 20 μm. When a high speed shearing dispersion device is used, there is no specific limit to the rotation speed. Normally the rotation speed is from 1,000 to 3,000 rpm and preferably from 5,000 to 20,000 rpm. There is no specific limit to the time length of dispersion. Normally it is from 0.1 to 5 minutes for a batch method dispersion. The temperature at dispersion is from 0 to 150° C. (under pressure) and more preferably from 40 to 98° C. The dispersion liquid can have a low viscosity at a high temperature and thus dispersion is easy. Thus a higher temperature is preferred.

The content of the aqueous medium to 100 parts by weight of the toner solid matter including the prepolymer (A), the colorant, the release agent and the polyester resin (D) included in the oily dispersion liquid is from 50 to 2,000 parts by weight and preferably from 100 to 1,000 parts by weight. When the content of a toner solid matter is too small, the dispersion state thereof is bad and thereby obtained toner particles do not have a desired particle diameter. In addition, it is not economical to have a toner solid matter having too large of a content. If necessary, dispersants can be used. Dispersants are preferably used in terms of the size distribution and the stability of dispersion. The time taken between the wet pulverization treatment of the oily liquid and the dispersion in the aqueous medium is preferably as short as possible.

Suitable aqueous media include water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone)

To emulsify (disperse) an oily phase including a toner solid matter in an aqueous medium, various types of surfactants (emulsifying agent) can be used as dispersant. Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a good dispersion can be prepared even when a small amount of the surfactant is used. Specific examples of the anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl (C3–C4) sulfonate, sodium 3-{omega-fluoroalkanoyl (C6–C8)-N-ethylamino}-1-propanesulfonate, fluoroalkyl (C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl (C6–C10)sulfoneamidepropyltrimethyl ammonium salts, salts of perfluoroalkyl(C6–C10)-N-ethylsulfonyl glycin, monoperfluoroalkyl(C6–C16)ethylphosphates, etc.

Specific examples of the marketed products of such surfactants having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include primary, secondary and tertiary aliphatic amino acids, aliphatic quaternary ammonium salts (such as perfluoroalkyl(C6–C10)sulfoneamidepropyltrimethyl ammonium salts), benzalkonium salts, benzetonium chloride, pyridinium salts, imidazolinium salts, etc., all of which have a fluoroalkyl group. Specific examples of the marketed products thereof include SURFLON® S-121 (from Asahi Glass Co., Ltd.); FRORARDO® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Known inorganic compounds which are insoluble or hardly soluble to water are used as inorganic particulates existing in the aqueous medium. Specific examples of the inorganic compounds include tricalcium-phosphate, calcium carbonate, titanium oxide, colloidal silica, hydroxyapatite, etc.

As particulate polymers present in the aqueous medium, known materials insoluble or hardly soluble to water can be used. Specific examples of the particulate polymers include particulates of hydrophbized polymers such as hydrocarbon resins, resins including fluorine and silicone resins.

The particulates mentioned above have a small particle diameter relative to that of the toner. In terms of uniformity in the particle diameters, the particle diameter ratio (Pvd/Tvd) of the volume average particle diameter (Pvd) of the particulates to the volume average particle diameter (Tvd) of the toner particles is preferably from 0.001 to 0.3. When the particle diameter ratio (Pvd/Tvd) mentioned above is too large, the particulates tend not to be efficiently attached to the surface of the toner particles and therefore the size distribution of the toner particles obtained tend to be wide.

To obtain toner particle having a desired particle diameter, it is possible to control the volume average particle diameter of particulates in the range of the particle diameter ratio mentioned above. For example, to obtain toner particles having a volume average particle diameter of 5 μm, the ratio is preferably from 0.0025 to 1.5 μm, and more preferably from 0.005 to 1.0 μm. To obtain toner particles having a volume average particle diameter of 10 μm, the ratio is preferably from 0.005 to 3.0 μm, and more preferably from 0.05 to 2.0 μm.

In the embodiment of the present invention, the aqueous medium can contain various types of hydrophilic polymers forming a polymeric protection colloid therein as a dispersion stabilizer. Specific examples of monomers constituting such hydrophilic polymers in an aqueous medium include acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g. acrylamide, methacrylamide and diacetoneacrylamide) and their methylol compounds, acid chlorides (e.g., acrylic acid chloride and methacrylic acid chloride), and monomers having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used for the embodiments of the present invention.

To remove the liquid medium from the emulsified dispersion liquid obtained as the reaction product of polyaddition reaction of the prepolymer (A) and the amine (B), a method including the process of gradually heating the entire system to remove the organic solvent by evaporation can be adopted in the embodiments of the present invention. The circularity of toner particles can be controlled by the vigorousness of agitation performed before removing this organic solvent and the time to take to remove the organic solvent. When the organic solvent is slowly removed, the toner circularity is not less than 0.980 by true sphericity. To the contrary, when the reaction solvent is vigorously stirred in a short time to remove the organic solvent, the toner particles obtained have an irregular form or a rough form and has a true sphericity of from 0.900 to 0.950. It is possible to control the toner form in the range of 0.850 to 0.990 by true sphericity when the organic solvent is removed while vigorously stirring the emulsification liquid, which is obtained after the emulsified dispersion in the aqueous medium and the further reaction thereafter, in the agitation bath at a temperature between 30 to 50° C. This is thought to be caused by volume shrinkage occurring while the organic solvent such as acetic ether is rapidly removed in the process of forming toner particles.

There is an alternative method of removing the liquid medium mentioned above. In this method, the emulsified dispersion liquid is sprayed in a dry atmosphere to completely remove the organic solvent to form toner particulates and to remove the aqueous dispersant by evaporation. Specific preferred examples of such a dry atmosphere include heated gases of air, nitrogen, carbon dioxide, combustion gas, etc. It is preferred to use flows of those gases heated to a temperature not lower than the boiling point of the liquid medium having the highest boiling point among the solvents used in the emulsion. Quality toner particles can be prepared after short-time treatments using a spray dryer, a belt dryer, a rotary kiln, or the like. The time it takes to remove the solvent after the dispersion liquid is obtained after the reaction is preferably short, i.e., not longer than 25 hours.

When compounds such as calcium phosphate salts soluble to an acid or alkali are used as inorganic particulates, it is possible to remove the inorganic particulates from the obtained toner particles, for example, by dissolving the inorganic particulates with an acid such as hydrochloric acid and washing the resultant with water. In addition, the inorganic particulates can be removed by using a zymolytic method.

When a dispersant is used, it is possible to leave the dispersant on the surface of toner particles. However, considering the chargeability of the toner particles, it is preferred to wash away and remove the dispersant after the reaction of the prepolymer (A) and the amine (B).

Further, to decrease the viscosity of the dispersion liquid obtained after the reaction, a solvent which can dissolve the prepolymer (A) and the urea modified polyester can be added in the aqueous medium. It is preferred to use such solvents to allow the resultant toner to have a sharp size distribution. Volatile solvents having a boiling point lower than 100° C. are preferably used because such solvents can be removed with ease after the toner particles are formed.

Specific preferred examples of such solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, aromatic solvents such as toluene and xylene, and halogenated hydrocarbons such as methylene chloride, 1,2-dichloroethane, chloroform, and carbon tetrachloride are more preferably used.

The addition amount of such solvents is not limited, but is generally from 0 to 300 parts by weight, preferably from 0 to 100 parts by weight and more preferably from 25 to 70 parts by weight, per 100 parts by weight of the prepolymer (A) used. When such a solvent is used to prepare a dispersion liquid, the solvent is removed upon application of heat under a normal or reduced pressure after toner particles are formed after the reaction of the prepolymer (A) and the amine (B).

The reaction time of the prepolymer (A) and the amine (B) is determined by the reaction property of the combination of the isocyanate group structure of the prepolymer (A) and the amine (B), but the reaction time is generally from 10 minutes to 40 hours, and preferably from 2 to 24 hours. The reaction temperature is generally from 0 to 150° C. and preferably from 40 to 98° C. In addition, known catalysts can optionally be used. Specific preferred examples of the catalysts include dibutyltin laurate and dioctyltin laurate.

When the size distribution of the toner particle in the emulsified dispersion liquid after the reaction of the prepolymer (A) and the amine (B) is wide, and washing and drying treatments are performed while keeping the size distribution wide, it is possible to prepare toner particles having a desired size distribution by classifying the produced toner particles. Fine particles can be removed by classification using a cyclone, a decanter or a device using a centrifugal force while the toner is in a liquid. It is also possible to classify toner particles obtained as powder form after drying. However classification in a liquid is preferred in light of efficiency. The thus obtained unwanted fine particles and coarse particles can be returned to the kneading process again to form particles having a proper size even when those fine particles and coarse particles are wet.

It is preferred to remove the used dispersant from the obtained dispersion liquid as much as possible and also preferred to remove it while in the classification mentioned above.

The toner particles obtained after drying can be mixed and used with particulates of other materials such as release agents, charge controlling agents and fluidizers on a necessity basis. These particulates can be fixed and fused on the surface of a toner particle by a mechanical impact onto the mixture powder and thereby these particulates can be prevented from detaching from the surface of the obtained complex particle. Specific preferred examples of such methods include: a method of providing an impact on a mixture with a blade rotating at a high speed; and another method of colliding particles against each other or complex particles against a collision board by throwing a mixture into a high speed air flow. Specific more preferred examples of such mechanical impact applicators include ONG MILL (manufactured by Hosokawa Micron Co., Ltd.), a device modified based on I TYPE MILL (manufactured by Nippon Pneumatic Mfg. Co., Ltd.) in which the air pressure for pulverizing is reduced, HYBRIDIZATION SYSTEM (manufactured by Nara Machine Co., Ltd.), KRYPTRON SYSTEM (manufactured by Kawasaki Heavy Industries, Ltd.), and automatic mortars.

The toner for use in the embodiments of the present invention can be mixed with magnetic carrier and used as two-component developer. The weight ratio (T/C) of the toner (T) to the carrier (C) is preferably from 1/100 to 10/100. Suitable preferred carriers for use in such two component developers include any known carrier materials such as iron powders, ferrite powders, magnetite powders, magnetic resin carriers, which have a particle diameter of from about 20 μm to about 200 μm. The surface of the carriers may be coated with a resin and specific preferred examples of such resins coating the carriers include amino resins such as urea-formaldehyde resins, melamine resins, benzoguanamine resins, urea resins, and polyamide resins, and epoxy resins. In addition, polyvinyl or polyvinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers such as terpolymer of tetrafluoroethylene, vinylidenefluoride and other monomers including no fluorine atom, and silicone resins can be used.

If desired, conductive powder may be included in the coating resin. Specific preferred examples of such conductive powders include metal powders, carbon blacks, titanium oxides, tin oxides, and zinc oxides. The average particle diameter of such conductive powders is preferably not greater than 1 μm. When the particle diameter is too large, it is hard to control the resistance thereof. The toner of the present invention can also be used without carrier as a single component magnetic toner or a single component non-magnetic toner, which does not use a carrier.

The toners for use in the embodiments of the present invention are numbered and further described but not intended to be limiting.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Toner 1)

(Manufacturing Example of Polyesters for Addition)

The following components were contained in a reaction container having a condenser, a stirrer and a nitrogen introducing tube and polyadded for 10 hours at 210° C. under normal pressure.

| | |
|---|---|
| Adduct of bisphenol A with 2 moles of ethylene oxide | 690 |
| Terephthalic acid | 230 |

Then the reaction was further continued for 5 hours under a reduced pressure of from 10 to 15 mmHg. Subsequent to cooling down to 160° C., 18 parts of phthalic anhydride were added thereto to perform a reaction for 2 hours. Thus, unmodified polyester (a) having a weight average molecular weight Mw of 85,000 was prepared.

(Manufacturing Example of Prepolymer)

The following components were contained in a reaction container having a condenser, a stirrer and a nitrogen introducing tube and reacted for 8 hours at 230° C. under normal pressure.

| | |
|---|---|
| Adduct of bisphenol A with 2 moles of ethylene oxide | 800 |
| Isophthalic acid | 160 |
| Terephthalic acid | 60 |
| Dibutyl tin oxide | 2 |

Then the reaction was further continued for 5 hours under a reduced pressure of from 10 to 15 mmHg while dehydrating. Subsequent to cooling down to 160° C., 32 parts of phthalic anhydride were added thereto to perform a reaction for 2 hours. Subsequent to further cooling down to 80° C., 170 parts of isophorone diisocyanate were added thereto in ethyl acetate to react for another 2 hours. Thus, a prepolymer (1) having a weight average molecular weight of 35,000 containing an isocyanate group was prepared.

(Manufacturing Example of Ketimine Compounds)

The following components were contained in a reaction container having a stirrer and a thermometer and reacted for 5 hours.

| | |
|---|---|
| Isophoron diamine | 30 |
| Methylethyl ketone | 70 |

Consequently, a ketimine compound (1) was obtained.

(Manufacturing Example of the Toner)

The following components were set in a beaker and stirred and dissolved.

| | |
|---|---|
| Prepolymer (1) | 14.3 |
| Polyester (a) | 55 |
| Acetic ether | 78.6 |

Then 10 parts of rice wax functioning as release agent having a melting point of 83° C. and 4 parts of copper phthalocyanine blue colorant were added thereto. Subsequent to stirring at 40° C. by TK HOMOMIXER at 12,000 rpm for 5 minutes, the resultant was subject to pulverization treatment at 20° C. for 30 minutes using a bead mill to obtain a toner material oily dispersion liquid (1).

The following components were set in a beaker.

| | |
|---|---|
| Ion exchanged water | 306 |
| Ten % tricalcium phosphate suspension | 265 |
| Dodecyl benzene sulphonic sodium | 0.2 |

Then to this dispersant liquid (1), the toner material oily dispersion liquid (1) mentioned above and 2.7 part of a ketimine compound (1) were added to perform urea reaction while being stirred by TK HOMOMIXER at 12,000 rpm. The organic solvents were removed from the dispersion liquid obtained after the reaction having a viscosity of 3,500 mP·s within one hour at a temperature not higher than 50° C. under a reduced pressure. After filtering, washing, drying and air separating the resultant powder, mother toner particles (1) having a spherical form were obtained.

Next, 100 parts of the mother particle (1) obtained and 0.25 parts of a charge controlling agent (i.e., BONTRON E-84, manufactured by Orient Chemical Industries Co., Ltd.) were set in a Q MODEL MIXER (manufactured by Mitsui Mining Co., Ltd.) and subject to mixing treatment by a turbine type blade with the peripheral velocity of 50 m/s. The mixing treatment was operated for 10 minutes 5 cycles. Each cycle continues for 2 minutes with a one minute break therebetween.

Further, 0.5 parts of hydrophobic silica (i.e., H2000, manufactured by Clariant Japan K. K.) were added and mixed. This mixing treatment was performed by the turbine type blade with the peripheral velocity of 15 m/s for 2.5 minutes in 5 cycles. Each cycle continues for 0.5 minutes with a one minute break therebetween.

Consequently, a cyan toner (1) was obtained. This colorant toner has a particle diameter of 0.4 μm on average when dispersed. The ratio of the number of the toner particles having a particle diameter not less than 0.7 μm is 3.5% by number. Properties of this toner and their evaluations are shown in Tables 1 and 2.

Example 2

(Toner 2)

(Preparation of Magenta Master Batch Particle)

The following components were stirred by a flusher.

| | |
|---|---|
| Water | 600 |
| Pigment Red 57 wet cake (50% solid portion) | 200 |

Then, after 1,200 parts of a polyester resin having an acid value of 3 mgKOH/g, a hydroxyl value of 25 mgKOH/g, a number average molecule weight Mn of 3,500, a ratio (Mw/Mn) of a weight average molecular weight Mw to the number average molecular weight of 4.0, and a glass transition temperature (Tg) of 60° C. were added to the mixture, the mixture was kneaded for 30 minutes at 150° C. Further, 1,000 parts of xylene were added thereto and the mixture was kneaded for one hour. Subsequent to removal of water and xylene, the resultant was roll-cooled and pulverized and subject to 3 roll milling twice. Consequently, a magenta color master batch colorant MB1-M having an average particle diameter of about 0.2 μm was obtained.

(Manufacturing Example of a Prepolymer)

The following components were contained in a reaction container having a condenser, stirrer and a nitrogen introducing tube and reacted for 6 hours at 250° C. under normal pressure.

| | |
|---|---|
| Adduct of bisphenol A with 2 moles of ethylene oxide | 856 |
| Isophthalic acid | 200 |
| Terephthalic acid | 20 |
| Dibutyl tin oxide | 4 |

Then the reaction was further continued for 5 hours under a reduced pressure of from 50 to 100 mmHg while dehydrating. Subsequent to cooling down to 160° C., 18 parts of phthalic anhydride were added thereto to perform a reaction for 2 hours. Subsequent to further cooling down to 80° C., 170 parts of isophorone diisocyanate were added thereto in acetic ether to react for another 2 hours. Consequently, a prepolymer (2) having a weight average molecular weight Mw of 25,000 containing an isocyanate group was prepared.

(Manufacturing Example of the Toner)

The following components were set in a beaker and stirred and dissolved.

| | |
|---|---|
| Prepolymer (1) | 15.4 |
| Polyester (a) | 50 |
| Acetic ether | 95.2 |

Subsequent to addition of 10 parts of carnauba wax having a molecular weight of 1,800, an acid value of 2.5 mgKOH/g and a penetration of 1.5 mm at a temperature of 40° C. and 10 parts of the master batch particles of Example 2 to the beaker, the mixture was stirred by TK HOMOMIXER at 10,000 rpm at a temperature of 85° C. As in Example 1, the resultant was subject to wet pulverization treatment using a bead mill to obtain a toner material oily dispersion liquid (2). Next, a mother toner particle (2) was prepared in the same manner as in Example 1 except that the obtained toner material oily dispersion liquid (2) was used.

Then, a toner (2) was obtained in the same manner as in Example 1 except that the charge controlling agent used was not BONTRON E-84 but E-89. The colorant in this toner had an average particle diameter of 0.25 μm when dispersed and the number ratio of particles having a particle diameter not less than 0.5 μm was 1.0%. Properties of this toner and their evaluation are shown in Tables 1 and 2.

Example 3

(Toner 3)

(Manufacturing Example of a Prepolymer)

The following components were contained in a reaction container having a condenser, stirrer and a nitrogen introducing tube and reacted for 8 hours at 220° C. under normal pressure.

| | |
|---|---|
| Adduct of bisphenol A with 2 moles of ethylene oxide | 755 |
| Isophthalic acid | 195 |
| Terephthalic acid | 15 |
| Dibutyl tin oxide | 4 |

Then the reaction was further continued for 5 hours under a reduced pressure of from 50 to 100 mmHg while dehydrating. Subsequent to cooling down to 160° C., 10 parts of phthalic anhydride were added thereto to perform a reaction for 2 hours. Subsequent to further cooling down to 80° C., 170 parts of isophorone diisocyanate were added thereto in ethyl acetate to react for another 2 hours. Consequently, a prepolymer (3) having a weight average molecular weight of 25,000 containing an isocyanate group was prepared.

(Manufacturing Example of the Toner)

The following components were set in a beaker and stirred and dissolved.

| | |
|---|---|
| Prepolymer (3) | 15.4 |
| Polyester (a) | 50 |
| Acetic ether | 95.2 |

Subsequent to addition of 10 parts of carnauba wax having a molecular weight of 1,800, an acid value of 2.5 mgKOH/g and a penetration of 1.5 mm at a temperature of 40° C. and 15 parts of the master batch particles of Example 2 to the beaker, the mixture was stirred by TK HOMOMIXER at 14,000 rpm at 85° C. for uniform dispersion and then subject to wet pulverization treatment for 60 minutes at 15° C. using a bead mill. The resultant obtained was a toner material oily dispersion liquid (3). Then the following components were set and stirred in a beaker to obtain an aqueous dispersion liquid (3).

| | |
|---|---|
| Ion exchanged water | 465 |
| 10% suspension of Sodium carbonate | 245 |
| Sodium dodecyl benzene sulphonate | 0.4 |

Then the aqueous dispersion liquid (3) was heated to 40° C. The toner material oily dispersion liquid (3) was added to the aqueous dispersion liquid (3) while stirring the liquid using K HOMOMIXER at a rotation speed of 12,000 rpm.

Following a 10 minute stirring, 2.7 parts of the ketimine compound (1) were added to perform a reaction. Subsequent to removing the solvent within one hour at 40° C., a mother toner particle (3) was prepared in the same manner as in Example 2 and after filtering, washing, and drying, a mother toner particle (3) having a spherical form was obtained.

A toner (3) was prepared in the same manner as in Example 1 except that this mother toner particle (3) was used. The colorant in this toner had an average particle diameter of 0.15 μm when dispersed and the ratio of the number of particles having a particle diameter not less than 0.5 μm was 3.0% by number. Properties of this toner and their evaluations are shown in Tables 1 and 2.

Comparative Example 1

(Synthesis of a Toner Binder)

A comparative toner binder (11) was prepared by polyadding 354 parts of adducts of bisphenol A with 2 moles of ethylene oxide and 166 parts of isophthal acid using 2 parts of dibutyl tin oxide as catalyst. This comparative toner binder had a glass transition temperature (Tg) of 57° C.

(Manufacturing of the Toner)

A comparative dispersion liquid (11) was obtained by stirring the following components set in a beaker at 50° C. using TK HOMOMIXER at a rotation speed of 12,000 rpm.

| | |
|---|---|
| Comparative toner binder (11) | 100 |
| Acetic ether solution | 200 |
| Copper phthalocyanine blue | 4 |
| Rice wax of Example 1 | 5 |

A comparative toner (11) was prepared in the same manner as in Example 1 except that this comparative dispersion liquid (11) was used. The obtained comparative toner (11) had a volume average particle diameter of 6 μm. The colorant contained in this toner had an average particle diameter of 0.70 μm when dispersed and the ratio of the number of the particles having a particle diameter not less than 0.70 μm was 35% by number. Properties of this toner and their evaluations are shown in Tables 1 and 2.

Comparative Example 2

(Synthesis of a Toner Binder)

The following components were contained in a reacting container having a condenser, stirrer and a nitrogen introducing tube and reacted for 8 hours at 230° C. under normal pressure.

| | |
|---|---|
| Adduct of bisphenol A with 2 moles of ethylene oxide | 343 |
| Isophthalic acid | 166 |
| Dibutyl tin oxide | 2 |

Then the reaction was further continued for 5 hours under a reduced pressure of from 10 to 15 mmHg. Subsequent to cooling down to 80° C., 14 parts of toluene diisocyanate was added thereto in toluene and the mixture reacted at 110° C. for 5 hours. After removing the solvent, a urethane modified polyester having a peak molecular weight of 7,000 was obtained. Next, 363 parts of an adduct of bisphenol A with 2 moles of ethylene oxide and 166 parts of isophthalic acid were polyadded in the same manner as in Example 1 to obtain an unmodified polyester having a peak molecular weight of 3,800 and an acid value of 7 mgKOH/g. Then, 350 parts of the urethane modified polyester mentioned above and 650 parts of the unmodified polyester were dissolved and mixed in toluene. After removing the solvent therefrom, comparative mother toner particles (12) were obtained. This comparative toner binder (12) had a glass transition temperature (Tg) of 58° C.

(Manufacturing of the Toner)

A toner was prepared by the following method using 100 parts of the comparative toner binder (12), 10 parts of the master batch particles of Example 2 and 10 parts of carnauba wax.

The components were preliminarily mixed with a Henschel mixer and kneaded with a continuous kneader. After finely pulverizing the resultant with a jet pulverizer, the resultant powder was classified by an air separator and toner particles having a volume average particle diameter of 6 μm were obtained. Then a comparative toner (12) was obtained by mixing 100 parts of the toner particles, 0.5 parts of hydrophobic silica and 0.5 parts of hydrophobic titanium oxide with a Henschel mixer. The colorant contained in the toner had a particle diameter of 0.7 μm on average when dispersed. The ratio of the number of the toner particles having a particle diameter not less than 0.7 μm is 15.0% by number. Properties of this toner and their evaluations are shown in Tables 1 and 2.

The toners (1) to (3) and (11) to (12) were evaluated as follows.

(Evaluation Method)

(1) Glass Transition Temperature (Tg)

The measuring method of Tg is briefly described below. As a device for measuring Tg, TG-DSC SYSTEM TAS-100 (manufactured by Rigaku Corporation) was used.

About 10 mg of a sample was set in a sample container made of aluminum. The sample container was held on a holder unit and set in an electric furnace. The furnace was heated from room temperature to 150° C. at a rising speed of 10° C. per minute. When the temperature of the furnace reached 150° C., the furnace was left for 10 minutes to cool the sample down to room temperature. The sample was left undone for another 10 minutes. Then the sample was heated again to 150° C. in a nitrogen atmosphere at a rising sped of 10° C. per minute and measured using a differential scanning calorimeter (DSC). The glass transition temperature (Tg) was obtained by calculation based on the contact point of a tangential line of the endothermic curve around the Tg and the base line thereof using the analysis system in TAS-100 system.

(2) Acid Value

Acid value was determined based on the method specified at JISK0070. When a sample was not dissolved, dioxane or tetrahydrofuran was used as a solvent.

(3) Fluidity

Bulk density (g/(ml)) was measured using a powder tester (manufactured by Hosokawa Micron Corporation). A toner having a good fluidity has a large bulk density. The bulk density was ranked as follows (i.e., Poor, Fair, Good and Excellent):

Poor: less than 0.25

Fair: not less than 0.25 to less than 0.30

Good: not less than 0.30 to less than 0.35

Excellent: greater than 0.35

(4) Lowest Fixable Temperature

A photocopying test was performed using a fixing roller coated with TEFLON® remodeled based on the fixing roller of a photocopier (MF-200: manufactured by Ricoh Co.) and papers (Type 6200 manufactured by Ricoh Co.). The lowest fixable temperature is defined as the temperature of the fixing roller below which the fixed image has a remaining ratio less than 70% after the fixed image is abraded with a pad.

(5) Hot Offset Occurring Temperature (HOT)

The fixability was evaluated in the same manner as in the fixing lower limit temperature and hot offset on a fixed image was observed and evaluated with a naked eye. The hot offset temperature is defined as the temperature of the fixing roller above which a hot offset occurrs.

(6) Gloss Occurring Temperature (GLOSS)

The fixability was evaluated using a fixing device included in a color photocopier available in the market (PRETER 550: manufactured by Ricoh Co.). Gloss occurring temperature is defined as the temperature of the fixing roller below which the 60 degree angle gloss of the toner image is less than 10%.

(7) Degree of Haze

A direct reading haze computer (HGM-2DP model) was used.

Experiment Example

The surface potential of a pressing roller and a fixing belt was measured with a model surface voltmeter (344-JX (1.9 k): manufactured by Trek Inc.) using the toners and carriers of Examples and Comparative examples mentioned above while the surface resistivity of the fixing belt and the pressing roller were varied. A measuring probe was set just before the fixing nip portion and the surface potential was measured. The distance between the probe and the fixing nip portion was 1 mm. The density of an image attached onto the fixing belt was measured with X-Rite 938 (manufactured by X-Rite Corporation). The degree of haze was evaluated as follows:

G: Good

P: Rather poor

The image density was measured as follows: compulsorily stop the image forming apparatus immediately after an unfixed image on the transfer paper was fixed by the fixing belt; attach a transparent adhesive tape (Printack manufactured by Nitto Co., Ltd.) to the fixing belt to transfer the toner attached on the fixing belt; and measure the image density by attaching the transparent adhesive tape to a sheet of white paper. The measuring conditions were: the amount of the toner attached on the transfer paper was 0.5 mg/cm$^2$; the linear velocity of image formation was 125 mm/s; and the fixing control temperature was 175° C. At the time of fixing, toners fuse and may attach to the belt, namely "hot offset". However, this can be easily distinguished from the electrostatic offset because tarry images or ripped-off images are formed in the case of hot offset while not in the case of electrostatic offset.

To measure the surface resistivity, HIGHRESTA (a high resistance ohmmeter manufactured by Mitsubishi Chemical Corporation) was used. One hundred voltages were applied for 10 seconds using a 2-pin probe (HA probe) The value obtained 10 seconds after starting measurement was determined as the surface resistivity. The surface potentials of the pressing roller and the fixing roller were measured using a 344-JX model surface voltmeter (manufactured by Trek Inc.).

The image density difference ΔIDs (i.e., the difference value based on the density of the background) while the surface potential V of the fixing belt and the pressing roller are changed are shown in Table 3. The image density difference ΔID was measured three times and the measured values and their average are shown.

TABLE 1

| | Properties of toner binders | | |
|---|---|---|---|
| Toner No. | Peak molecular weight | Acid value (mgKOH/g) | Glass transition temperature (Tg) |
| 1 | 4000 | 10 | 55 |
| 2 | 5200 | 8 | 60 |
| 3 | 4500 | 15 | 62 |
| 4 | 6000 | 4 | 52 |
| 11 | 8000 | 7 | 57 |
| 12 | 7000 | 7 | 58 |

TABLE 2

| Toner No. | Dv | Dn | Dv/Dn | Circularity | Fluidity | Lowest fixable temperature (° C.) |
|---|---|---|---|---|---|---|
| 1 | 5.5 | 4.8 | 1.15 | 0.94 | 0.3 | 150 |
| 2 | 6.8 | 6.2 | 1.1 | 0.95 | 0.35 | 150 |
| 3 | 4.9 | 4.2 | 1.17 | 0.93 | 0.44 | 160 |
| 4 | 6.9 | 6.2 | 1.11 | 0.955 | 0.4 | 140 |
| 11 | 6 | 4.6 | 1.3 | 0.97 | 0.25 | 155 |
| 12 | 7.5 | 6.1 | 1.22 | 0.925 | 0.23 | 160 |

(Dv: Weight average molecular weight; Dn: Number average molecular weight)

| Toner No. | Hot offset property (° C.) | GLOSS (° C.) | Degree of haze | Particle diameter of colorant (μm) | The ratio of the number of particles having not less than 0.7 μm (%) |
|---|---|---|---|---|---|
| 1 | 220 | 160 | P | 0.4 | 3.5 |
| 2 | 220 | 150 | G | 0.25 | 1 |
| 3 | 230 | 160 | G | 0.15 | 2 |
| 4 | 220 | 140 | G | 0.15 | 3 |
| 11 | 200 | 155 | P | 0.7 | 35 |
| 12 | 180 | 160 | P | 0.7 | 15 |

(GLOSS: A fixing roller temperature when the 60 degree angle gloss is 10%).

TABLE 3

| | Fixing belt | | | | | | | | |
|---|---|---|---|---|---|---|---|---|---|
| | [3] Surface resistivity: not greater than $1 \times 10^9$ | | | [2] Surface resistivity: from $1 \times 10^{11}$ to $1 \times 10^{12}$ | | | [1] Surface resistivity: not less than $1 \times 10^{13}$ | | |
| Pressing roller | Voltage (V) | ΔID | Average | Voltage (V) | ΔID | Average | Voltage (V) | ΔID | Average |
| (3) Surface resistivity: not greater than $1 \times 10^8$ | −10/+10 (belt/ roller) | 0.001<br>0.001<br>0.002 | 0.001 | −10/+20 (belt/ roller) | 0.000<br>0.002<br>0.002 | 0.001 (belt/ (roller) | +30/+100 | 0.004<br>0.003<br>0.005 | 0.004 |
| (2) Surface resistivity: from $1 \times 10^{10}$ to $1 \times 10^{11}$ | +40/−300 | 0.009<br>0.009<br>0.010 | 0.009 | +35/−290 | 0.010<br>0.009<br>0.007 | 0.009 | +40/−300 | 0.007<br>0.007<br>0.010 | 0.008 |
| (1) Surface resistivity: not less than $1 \times 10^{13}$ | +45/−500 | 0.012<br>0.011<br>0.013 | 0.012 | +60/−500 | 0.013<br>0.011<br>0.013 | 0.012 | +60/−460 | 0.010<br>0.014<br>0.012 | 0.012 |

In Table 3, when the pressing roller had (1) a surface resistivity not less than $1\times10^{13}$ (Ω/□) (i.e., high resistivity), the surface potential of the pressing roller was from −460 to −500 V and the image density difference ΔID (i.e., average of the three measured values) was 0.012. When the pressing roller had (2) a surface resistivity from $1\times10^{10}$ to $1\times10^{11}$ (Ω/□) (i.e., middle-range resistivity), the surface potential of the pressing roller was reduced to from −290 to −300 V and the image density difference ΔID (i.e., average of the three measured values) was 0.009. When the pressing roller had (3) a surface resistivity not greater than $1\times10^{8}$ (Ω/□) (i.e., low resistivity), the surface potential of the pressing roller was reduced to not greater than 100 V and the image density difference ΔID (i.e., average of the three measured values) was not greater than 0.004, meaning that the amount of the attached toner caused by electrostatic offset was reduced.

The inventor of the present invention experimented with regard to the relationship between the background fouling (image density difference ΔID at the background portion) and the visual image fouling and obtained the results shown in Table 4. In terms of visual judgment, the level 4 shown in Table 4 is sufficient at shipment and at least 3.5 over time.

TABLE 4

| Image fouling level | ΔID |
|---|---|
| 5 | 0.0000 |
| 4.5 | 0.0001 |
| 4 | 0.0003 |
| 3.5 | 0.0005 |
| 3 | 0.0007 |
| 2 | 0.0011 |
| 1 | 0.0021 |

It is found that there is no practical problem when the image density difference ΔID is not greater than 0.003. Thus it is possible to prevent the background fouling which visually affects images by specifying the surface properties of the members used for fixing.

The inventor of the present invention thinks that the reasons why the results described above were obtained are as follows. When a pressing roller having a high surface resistivity, for example, (1) not less than $1\times10^{13}$ (Ω/□) or (2) from $1\times10^{10}$ to $1\times10^{11}$ (Ω/□), the surface potential of the pressing roller is high. This is thought to be because when the surface resistivity of the pressing roller is high, the electron charges generated by the triboelecric charging mentioned above tend to stay on the pressing roller. In this example, when a pressing roller having a surface resistivity (1) not less than $1\times10^{13}$ (Ω/□) or (2) of from $1\times10^{10}$ to $1\times10^{11}$(Ω/□) was used, the surface of the pressing roller was negatively charged and the fixing belt was positively charged. The correctly charged toner particles in this example had a negative charge and thus were transferred to the belt by electrostatic force.

In contrast, when the pressing roller had a low surface resistivity (i.e., (3) not greater than $10^{8}$(Ω/□)), it is found that the surface potential of the pressing roller was low. This is thought to be because when the surface resistivity of the pressing roller was low, the electric charges generated by triboelectric charge were hard to stay on the pressing roller and easily lead to ground. As a result, unfixed toners were prevented from transferring to the belt. Therefore, electrostatic offset was prevented. When the surface potential is not greater than 100 V in absolute value, the inventor of the present invention thinks that electrostatic offset ascribable to the surface potential can be effectively prevented irrespective of the polarity of the surface and the charged toner particles.

In addition, when the surface resistivity of the pressing roller was (1) not less than $1\times10^{13}$ (Ω/□) or (2) from $1\times10^{10}$ to $1\times10^{11}$(Ω/□), the image density difference ΔID was substantially the same regardless of the surface resistivity of the fixing belt and the surface potential of the fixing belt was not less than 35V. To the contrary, when the surface resistivity of the pressing roller was (3) not greater than $1\times10^{8}$ (Ω/□) and the surface resistivity of the fixing belt was [1] not less than $1\times10^{13}$ (Ω/□) (i.e., high resistivity), the surface potential of the fixing belt was reduced to +30 V and the image density difference ΔID is 0.004.

In contrast, when the surface resistivity of the pressing roller was (3) not greater than $1\times10^{8}$ (Ω/□) and the surface resistivity of the fixing belt was [2] from $1\times10^{11}$ to $10^{12}$ (Ω/□) (i.e., middle-range resistivity) or[3] not greater than $1\times10^{9}$ (Ω/□) (i.e., low resistivity), the surface potential of the fixing belt was further reduced to −10 V and the image density difference ΔID was 0.001. Therefore, when the surface resistivity of the pressing roller was (3) not greater than $1\times10^{8}$ (Ω/□) and the surface resistivity of the fixing belt was [2] from $1\times10^{11}$ to $10^{12}$ (Ω/□) or [3] not greater than $1\times10^{9}$ (Ω/□), the surface voltage of the fixing belt was not greater than 30 V in absolute value and thus it is possible to effectively reduce electrostatic offset.

The printer used in the examples described above is just an example to which the present invention can be applied and is not limiting. The members used in the examples described above are just examples to which the present invention can be applied and any member having a desired surface resistivity is usable. The toners used in the examples described above are just an example of image forming material to which the present invention can be applied and are not limiting.

According to Examples described above, the surface resistivity of the pressing roller 31 was not greater than $1\times10^{8}$ (Ω/□). Thereby, it was possible to reduce the surface potential of the pressing roller 31 to from −100 V to +100 V and thus to prevent electrostatic offset by reducing the amount of unfixed toner attached to the fixing belt by a simple structure without a bias application.

In addition, the surface resistivity of the fixing belt was not greater than $1\times10^{12}$ (Ω/□) and thereby it was possible to reduce the surface potential of the fixing belt to from not greater than +30 V to not less than −30 (V) and therefore to further prevent electrostatic offset by reducing the amount of unfixed toner attracted to the fixing belt.

In addition, by using the polymerized toner of the examples described above, the amount of unfixed toner attracted to the fixing belt was reduced with a simple structure without a bias application, resulting in prevention of electrostatic offset. Further, it was possible to obtain quality images excellent in transparency and color saturation (vividness and gloss) by using a toner having excellent powder fluidity, hot off resistance, charging stability and transferability in which colorants were highly dispersed.

This document claims priority and contains subject matter related to Japanese Patent Applications Nos. 2003-203761 and 2003-421230, filed on Jul. 30, 2003, and Dec. 18, 2003, respectively, which are incorporated herein by reference in their entity.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. A fixing device configured to fix a toner image borne on a side of a transfer material, comprising:

a heating member configured to heat the toner image while contacting the toner image borne on the transfer material and;

a pressing member configured to press the transfer material to the heating member, wherein a surface of the pressing member has a surface potential of not greater than 100 V in absolute value such that toner particles forming the toner image are not electrostatically repelled from the transfer material toward the heating member.

2. The fixing device according to claim 1, wherein the heating member includes an endless belt, and wherein a surface potential of the endless belt is not greater than 30 V in absolute value at a portion which is located just before a contact nip formed by the endless belt and the pressing member.

3. The fixing device according to claim 1, wherein the heating member comprises an endless belt, and the pressing member comprises a roller which forms a contact nip with the endless belt while interlockingly rotating with the endless belt, and wherein the roller has a surface potential such that the toner particles are not electrostatically repelled toward the endless belt.

4. The fixing device according to claim 3, wherein the pressing member has a surface resistivity not greater than $1\times10^{8}$ (Ω/□).

5. The fixing device according to claim 4, wherein the heating member has a surface resistivity not greater than $1\times10^{12}$ (Ω/□).

6. An image forming apparatus, comprising:

a latent bearing member configured to bear a latent electrostatic image;

a developing device configured to develop the latent electrostatic image formed on the image bearing member with a toner;

a transfer device configured to transfer the toner image formed on the latent image bearing member to a recording material; and the fixing device of claim 1.

7. The image forming apparatus according to claim 6, wherein the developing device uses a polymerized toner as an image forming material to form an image on a recording material, the polymerized toner being prepared by a method comprising:

dissolving or dispersing a modified polyester prepolymer, a compound to perform at least one of an elongation reaction and a cross-linking reaction with the modified polyester prepolymer and a toner constituent comprising a colorant in an organic solvent to obtain a toner composition material liquid;

performing at least one of an elongation reaction and a cross-linking reaction of the toner composition material liquid in an aqueous medium to obtain a dispersion liquid; and removing the organic solvent from the dispersion liquid.

8. The image forming apparatus according to claim 7, wherein the colorant dispersed in the polymerized toner has a number average dispersion particle diameter not greater than 0.5 μm and a number ratio of the colorant having a particle diameter not less than 0.7 μm is not greater than 5% by number.

9. The image forming apparatus according to claim 7, wherein the colorant contained in the polymerized toner has a number average dispersion particle diameter not greater than 0.3 μm and a number ratio of the colorant having a particle diameter not less than 0.5 μm is not greater than 10% by number.

10. The image forming apparatus according to claim 7, wherein the polymerized toner has a weight average particle diameter of from 3.0 to 7.0 μm and a particle diameter distribution satisfying the following relationship: $1.00 \leqq Dv/Dn \leqq 1.20$, where Dv and Dn represent a weight average particle diameter and a number average particle diameter, respectively.

11. The image forming apparatus according to claim 7, wherein the polymerized toner has a circularity of from 0.900 to 0.9 60.

12. The image forming apparatus according to claim 7, wherein a portion of the polyester resin contained in the polymerized toner which is soluble to tetrahydrofuran has a main peak in an area ranging from a molecular weight of 2,500 to 10,000 in a molecular weight distribution and has a number average molecular weight of from 2,500 to 50,000.

13. The image forming apparatus according to claim 7, wherein the polyester resin contained in the polymerized toner has a glass transition temperature of from 40 to 65° C. and an acid value of from 1 to 30 mg[KOH]/g.

14. The image forming apparatus according to claim 7, wherein the compound to perform at least one of an elongation reaction and a cross-linking reaction with the modified polyester prepolymer is an amine and a polyester resin inactive with the amine is dissolved in the toner composition material liquid of the polymerized toner.

15. The image forming apparatus according to claim 7, wherein a developer comprising the polymerized toner and a carrier is used.

16. A process cartridge, comprising at least one of:

a latent image bearing member;

a developing device;

a transferring device; and a cleaner, wherein the process cartridge is detachably attached to the image forming apparatus of claim 6.

17. A fixing device configured to fix a toner image borne on a side of a transfer material, comprising:

means for heating the toner image while contacting the toner image borne on the transfer material and;

means for pressing the transfer material to the heating member, wherein a surface of the pressing member has a surface potential of not greater than 100 V in absolute value such that toner particles forming the toner image are not electrostatically repelled from the transfer material toward the heating member.

* * * * *